US006497214B2

(12) United States Patent
Yagi

(10) Patent No.: US 6,497,214 B2
(45) Date of Patent: Dec. 24, 2002

(54) CONTROL SYSTEM FOR AN INTERNAL COMBUSTION ENGINE

(75) Inventor: Toyoji Yagi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/985,559

(22) Filed: Nov. 5, 2001

(65) Prior Publication Data

US 2002/0078924 A1 Jun. 27, 2002

(30) Foreign Application Priority Data

Nov. 6, 2000 (JP) ..... 2000-342369
Sep. 28, 2001 (JP) ..... 2001-299558

(51) Int. Cl.[7] ..... F02D 45/00
(52) U.S. Cl. ..... 123/399; 123/478; 701/104
(58) Field of Search ..... 123/399, 361, 123/478, 480, 492; 701/102, 105, 104

(56) References Cited

U.S. PATENT DOCUMENTS 4,552,116 A 11/1985 Kuroiwa et al. ..... 123/399
5,003,950 A * 4/1991 Kato et al. ..... 123/492
5,069,184 A * 12/1991 Kato et al. ..... 123/492
5,274,559 A * 12/1993 Takahashi et al. ..... 123/480
5,931,136 A 8/1999 Isobe et al. ..... 123/399
6,014,955 A * 1/2000 Hosotani et al. ..... 123/399

FOREIGN PATENT DOCUMENTS

JP 6-185396 * 7/1994 ..... F02D/41/34
JP 7-33781 4/1995
JP 8-277736 * 10/1996 ..... F02D/41/04
JP 10-89140 4/1998
JP 10-169491 6/1998
JP 10-205370 8/1998

* cited by examiner

*Primary Examiner*—Hieu T. Vo
(74) *Attorney, Agent, or Firm*—Nixon & Vanderhye P.C.

(57) ABSTRACT

An output timing of an opening degree command value $\phi$total is delayed by a predetermined delay time Tdly. A predictive throttle opening change $\Delta\theta$, calculated by using an electronic throttle model M4, is added to a present throttle opening degree $\theta$ to obtain a predictive throttle opening degree $\theta$f at an intake valve close timing. Then, a provisional predictive charged air amount Gcf is calculated based on the predictive throttle opening degree $\theta$f by using an intake system mode M5. Then, a predictive change $\Delta$Gc of the charged air amount at the intake valve close timing is calculated by derivative and integral processing the provisional predictive charged air amount Gcf until the intake valve close timing. Then, the predictive change $\Delta$Gc is added to a base charged air amount Gbase calculated by a base intake system model M8 to obtain a final predictive charged air amount Gc.

14 Claims, 21 Drawing Sheets

CONTROL SYSTEM FOR AN INTERNAL COMBUSTION ENGINE

BACKGROUND OF THE INVENTION

The present invention relates to a control apparatus for an internal combustion engine using an improved method for calculating an air amount charged into a cylinder of an engine.

To meet the recent severe law regulations relating to purification of exhaust gas, it is necessary to accurately perform an air-fuel ratio control (i.e., a fuel injection control). To this end, it is necessary to accurately calculate an air amount charged into an engine cylinder (i.e., a charged air amount) and appropriately set a fuel injection amount in accordance with the charged air amount.

One of two conventional methods for calculating a charged air amount is referred to as a mass flow method according to which an airflow meter is provided at an upstream side of a throttle valve to measure an intake airflow amount and then a charged air amount is calculated based on the measured intake airflow amount. The other conventional method is referred to as a speed density method according to which an intake pressure sensor is provided at a downstream side of a throttle valve to measure an intake pressure and then a charged air amount is calculated based on the measured intake pressure and an engine speed.

It is however impossible to accurately determine the charged air amount before an intake valve is completely closed (this timing is referred to as an intake valve close timing that corresponds to termination of an intake stroke). On the other hand, a timing for calculating a fuel injection amount (i.e., a fuel injection amount calculating timing) is earlier than the intake valve close timing because a fuel injector injects fuel into an intake passage upstream of the intake valve and therefore the fuel injection must be completed before the intake valve is closed.

In general, the charged air amount varies widely during a transient state of engine operating conditions. Accordingly, the charged air amount causes a significant change even in a short period of time between the fuel injection amount calculating timing to the intake valve close timing. As a result, a ratio of an actual charged air amount to the injected fuel amount (i.e., an actual air-fuel ratio) will possibly deviate from a target value (i.e., a target air-fuel ratio). In other words, the accuracy of the air-fuel control will be worsened during such a transient state of the engine operation.

SUMMARY OF THE INVENTION

In view of the foregoing problems of the prior art, the present invention has an object to provide a control apparatus for an internal combustion engine capable of improving the accuracy of the air-fuel ratio control during a transient state of the engine operating conditions.

To accomplish the above and other related objects, the present invention predicts a throttle opening degree at the intake valve close timing (i.e., a charged air amount determining timing), then predicts a charged air amount based on the predictive throttle opening degree, and finally calculates a fuel injection amount based on the predictive charged air amount. The reason why the present invention uses the throttle opening degree as a parameter for predicting the charged air amount is that a variation of the charged air amount originates from a change of the throttle opening degree. Thus, it is believed that any variation of the charged air amount is accurately and responsively predictable based on a change of the throttle opening degree.

To this end, the present invention provides a first control apparatus for an internal combustion engine comprising an electronic throttle system for controlling a throttle opening degree, including a throttle actuator for driving a throttle valve. An opening degree command calculating means is provided for calculating an opening degree command value based on an accelerator depression amount. A delay means is provided for delaying an output timing of the opening degree command value calculated by the opening degree command calculating means sent to the throttle actuator. A throttle opening degree predicting means is provided for obtaining a predictive throttle opening degree based on a non-delayed opening degree command value being not delayed by the delay means and response delay characteristics of the electronic throttle system, at a timing prior to outputting a delayed opening degree command value. A charged air amount predicting means is provided for obtaining a predictive charged air amount charged into an engine cylinder based on the predictive throttle opening degree obtained by the throttle opening degree predicting means. And, a fuel injection amount calculating means is provided for calculating a fuel injection amount based on the predictive charged air amount obtained by the charged air amount predicting means.

With this arrangement, it becomes possible to predict the throttle opening degree at an intake valve close timing (i.e., at the charged air amount determining timing) by appropriately delaying the output timing of the opening degree command sent to the throttle actuator. In general, an electronic throttle system includes a response delay (or a response lag) in its operation. Thus, the throttle opening degree is predicted based on the non-delayed opening degree command value being not delayed by the delay means and response delay characteristics of the electronic throttle system, at a timing prior to outputting the delayed opening degree command value. Thus, the first control apparatus for an internal combustion engine of the present invention can accurately predict the throttle opening degree at the intake valve close timing, and accurately predict the charged air amount charged into the engine cylinder based on the predicted throttle opening degree. As a result, the air-fuel ratio control accuracy can be improved during a transient state of engine operation.

Predicting a charged air amount based on the predictive throttle opening degree is advantageous in that good response is assured during the transient state. However, merely relying on the predictive charged air amount is not desirable in that a predictive charged air amount in a stationary state tends to deviate from the actual value due to dispersion or aging of the electronic throttle system or due to driving conditions. Furthermore, the charged air amount does not vary in a stationary condition. In other words, a charged air amount calculated based on present operating parameters (intake airflow amount, intake pressure etc.) substantially agrees with the charged air amount determined at a succeeding intake valve close timing.

In view of the above, it is preferable that the charged air amount predicting means obtains a predictive change of charged air amount during a predetermined predictive time terminating at an intake valve close timing based on the predictive throttle opening degree obtained by the throttle opening degree predicting means. The obtained predictive change of charged air amount is added to a base charged air amount obtained based on present operating parameters to obtain the predictive charged air amount.

This makes it possible to accurately predict a charged air amount charged into the engine cylinder in each intake stroke in both of stationary and transient states.

Furthermore, it is preferable that the charged air amount predicting means uses an intake system model according to which a throttle opening is regarded as an orifice and the law of mass conservation is applied to a throttled air amount and an intake air flowing in a throttle downstream intake passage, and the predictive change of charged air amount is obtained by integrating an output of this intake system model during the predictive time terminating at an intake valve close timing. By using this intake system model, it becomes possible to accurately predict the change of charged air amount through a relatively simple calculation.

Furthermore, it is preferable that the throttled air amount is obtained in the intake system model according to the following expression $$Gin = \mu \cdot A \cdot \frac{Pa}{\sqrt{R \cdot T}} \cdot f(Pm/Pa)$$

Gin: throttled air amount [kg/sec]

$\mu$: flow coefficient

A: effective cross-sectional area of throttle opening [$m^2$]

Pa: atmospheric pressure [Pa]

Pm: intake pressure [Pa]

R: gas constant

T: intake temperature [K]

f(Pm/Pa): physical value determined based on a ratio of Pm to Pa, f(Pm/Pa)=a negative value when Pm/Pa>1

$A=\pi r^2(1-\cos^2\theta)$ r: radius of throttle valve [m]

θ: throttle opening degree

In this case, the charged air amount predicting means calculates f(Pm/Pa) from a table with a parameter of Pm/Pa, and calculates $\mu \cdot A$ from a table with a parameter of the predictive throttle opening degree (θf).

Furthermore, it is preferable that the table used for calculating f(Pm/Pa) is set in the following manner f(Pm/Pa)=a positive value when Pm/Pa<1 f(Pm/Pa)=0 when Pm/Pa=1 and f(Pm/Pa)=a negative value when Pm/Pa>1 wherein the charged air amount predicting means includes a means for averaging a calculation value of the intake system model.

As described later, f(Pm/Pa) is physically a non-negative value. Setting f(Pm/Pa)=0 in the region Pm/Pa>1 possibly causes a hunting phenomenon of calculation values in the intake system model during a high load operating condition (i.e., when Pm/Pa is in the vicinity of 1). This is believed because a change rate of f(Pm/Pa) becomes large when Pm/Pa is in the vicinity of 1. Every time when the calculated value Pm/Pa becomes equal to or larger than 1, f(Pm/Pa) is guarded at 0. Thus, the change of f(Pm/Pa) becomes irregular during the high load operating condition.

To solve this problem, f(Pm/Pa) is set to a negative value when Pm/Pa>1 so that the variation of f(Pm/Pa) becomes regular during the high load operating condition. By averaging the calculation value of the intake system model, it becomes possible to stabilize the calculation value of the intake system model, thereby preventing the hunting phenomenon during the high load operating condition.

Furthermore, it is preferable that the delay means sets a delay time Tdly of the opening degree command value, wherein the delay time Tdly is expressed by $$Tdly=Tinj-Tth$$

when Tinj represents the predictive time from a fuel injection amount calculating timing (i.e., a charged air amount predicting timing) to the intake valve close timing, and Tth represents a dead time of the electronic throttle system.

This makes it possible set the delay time Tdly so as to equalize the predictive throttle opening degree with the actual throttle opening degree at the intake valve close timing. In other words, the calculation of the predictive throttle opening degree becomes easy.

In this case, the dead time Tth of the electronic throttle system is a constant value irrelevant to a throttle driving speed. On the other hand, the predictive time Tinj decreases with increasing engine speed and may become shorter than the dead time Tth in a high engine speed region.

Considering this point, it is preferable that the delay means outputs the opening degree command value without any delay when the predictive time Tinj is shorter than the dead time Tth. This prevents a useless throttle delay control in the high engine speed region. The throttle response at the high engine speed region is improved.

Furthermore, it is preferable that the delay means outputs the opening degree command value without any delay when the engine is in any one of the following conditions:

① a predetermined time has not elapsed since the engine operation is started;

② the engine is in an idling condition; and

③ an automatic transmission is in a neutral condition.

In general, immediately after the engine operation is started, the engine operating condition is unstable. If the throttle delay control is forcibly executed to delay the output timing of the opening degree command, the engine speed will fluctuate largely. Furthermore, the throttle delay control possibly interferes with the idling speed control. The idling speed will become unstable. When the automatic transmission is in a neutral condition, the engine usually race in response to a depression of an accelerator pedal. A driver may test the response of an engine through the racing. However, if the throttle delay control is performed during the neutral condition, the driver will feel that this engine has bad response.

Accordingly, any adverse influence caused by the throttle delay control can be eliminated by prohibiting the throttle delay control in the above specific engine operating conditions (i.e., startup, idling, neutral).

Furthermore, it is preferable that the throttle opening degree predicting means obtains the predictive throttle opening degree responsive to a delayed outputting of the opening degree command value by using an electronic throttle model including a first-order or more higher order delay element inputting the non-delayed opening degree command value not delayed by the delay means and a speed limiter.

In general, the electronic throttle system is so complicated that its structure cannot be precisely expressed as a physical model. However, using the first-order or more higher order delay element to simulate the response delay characteristics of the electronic throttle system and also using the speed limiter to simulate the limit characteristics of the drive speed of a throttle valve can construct an simply processible electronic throttle model and can realize a reliable calculation for predicting the throttle opening degree without requiring highly advanced performance of CPU.

Furthermore, there is the possibility that the predictive throttle opening degree may deviate from the actual value doe to dispersion and aging of the electronic throttle system or due to driving condition.

Hence, it is preferable that the throttle opening degree predicting means obtains a predictive throttle opening change during a predetermined predictive time terminating at an intake valve close timing by using an electronic throttle model, and obtains the predictive throttle opening degree at the intake valve close timing by adding the predictive throttle opening change to a present throttle opening degree. The predicting accuracy of the throttle opening degree can be improved.

Furthermore, it is preferable that the fuel injection amount calculating means has a correcting means for correcting the fuel injection amount in accordance with engine operating conditions, and the correcting means uses a first correction factor for a load change caused by an accelerator depression which smaller than a second correction factor for a load change irrelevant to the accelerator depression.

Regarding a load change caused by the accelerator depression, it is relatively easy to accurately predict the charged air amount. Thus, a smaller fuel correction factor is used for the load change relating to the accelerator depression. On the other hand, a load change caused when an automatic transmission is shifted from a neutral range to a drive range, or a load change caused by a power steering device, a braking system, or an air-conditioning apparatus is not easily predictable based on the accelerator depression. Thus, a larger fuel correction factor is used for the load changed not relating to the accelerator depression.

Accordingly, the fuel injection amount calculating means can appropriately select the fuel correction factor according to the nature of a detected load change.

The present invention provides a second control apparatus for an internal combustion engine which does not rely on the throttle delay control. The second control apparatus for an internal combustion engine comprises an electronic throttle system for controlling a throttle opening degree, including a throttle actuator for driving a throttle valve. An opening degree command calculating means is provided for calculating an opening degree command value based on an accelerator depression amount. A throttle opening degree predicting means is provided for obtaining a predictive throttle opening degree at an intake valve close timing based on the opening degree command value calculated by the opening degree command calculating means and response delay characteristics of the electronic throttle system. A charged air amount predicting means is provided for obtaining a predictive charged air amount charged into an engine cylinder based on the predictive throttle opening degree obtained by the throttle opening degree predicting means. And, fuel injection amount calculating means is provided for calculating a fuel injection amount based on the predictive charged air amount obtained by the charged air amount predicting means.

With this arrangement, it becomes possible to predict the throttle opening degree based on the dead time of the electronic throttle system and therefore it becomes possible to accurately predict the charged air amount based on the predictive throttle opening degree. Thus, it becomes possible to improve the air-fuel control accuracy during a transient state.

In this case, it is preferable that the charged air amount predicting means obtains a predictive change of charged air amount during a predetermined predictive time terminating at an intake valve close timing based on the predictive throttle opening degree obtained by the throttle opening degree predicting means, and adds the predictive change of charged air amount to the base charged air amount obtained based on present operating parameters to obtain the predictive charged air amount.

The present invention provides a third control apparatus for an internal combustion engine which is applicable to a mechanical throttle system having a throttle valve directly linked with an accelerator pedal.

The third control apparatus for an internal combustion engine comprises a base charged air amount calculating means for calculating a base charged air amount based on present operating parameters. A change amount predicting means for obtaining a predictive change of charged air amount charged into an engine cylinder during a predetermined predictive time terminating at an intake valve close timing based on an output of an intake system model according to which a throttle opening is regarded as an orifice and the law of mass conservation is applied to a throttled air amount and an intake air flowing in a throttle downstream intake passage. A charged air amount predicting means is provided for obtaining a predictive charged air amount by adding the base charged air amount calculated by the base charged air amount calculating means to the predictive change obtained by the change amount predicting means. And, a fuel injection amount calculating means is provided for calculating a fuel injection amount based on the predictive charged air amount obtained by the charged air amount predicting means.

With this arrangement, it becomes possible to improve the calculation accuracy of the charged air amount even in a mechanical throttle system. Accordingly, the air-fuel control accuracy during a transient state can be improved.

The present invention provides a fourth control apparatus for an internal combustion engine which uses an intake system model which calculates a charged air amount charged into an engine cylinder based on an output of an intake airflow amount detecting means (e.g., an airflow meter).

The fourth control apparatus for an internal combustion engine comprises an intake airflow amount detecting means for detecting a flow amount of intake air flowing in an intake passage of an internal combustion engine. A calculating means, using an intake system model which simulates the behavior of intake air flowing in the intake passage after passing through a throttle valve and entering into the engine cylinder, is provided for calculating a charged air amount charged into an engine cylinder by inputting an output of the intake airflow amount detecting means into the intake system model to obtained an output of the intake system model as the charged air amount. In this case, a time constant of this intake system model is set to a smaller value so that a change of calculated charged air amount in this intake system model appears earlier than an actual change of charged air amount.

Setting such a smaller time constant brings the same effects as that brought by predicting the future charged air amount based on the throttle opening degree. Thus, the calculating accuracy of the charged air amount during a transient state can be improved. And therefore, the control accuracy of the air-fuel ratio during a transient state can be improved.

The present invention provides a fifth control apparatus for an internal combustion engine which uses two kinds of intake system models for predicting the air amount charged into an engine cylinder.

The fifth control apparatus for an internal combustion engine comprises a present charged air amount estimating means for estimating a present charged air amount charged into an engine cylinder based on a present throttle opening degree. A throttle opening degree predicting means is provided for estimating a future throttle opening degree. A future charged air amount estimating means is provided for predicting a future charged air amount based on the future throttle opening degree. A predictive charged air amount calculating means is provided for obtaining a difference between the future charged air amount and the present charged air amount and adding the obtained difference to a base charged air amount calculated based on present operating parameters to obtain a final predictive charged air amount. And, a fuel injection amount calculating means is provided for calculating a fuel injection amount based on the final predictive charged air amount.

With this arrangement, it becomes possible to accurately predict a change of charged air and therefore it becomes possible to improve the predicting accuracy of the air charged into an engine cylinder.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
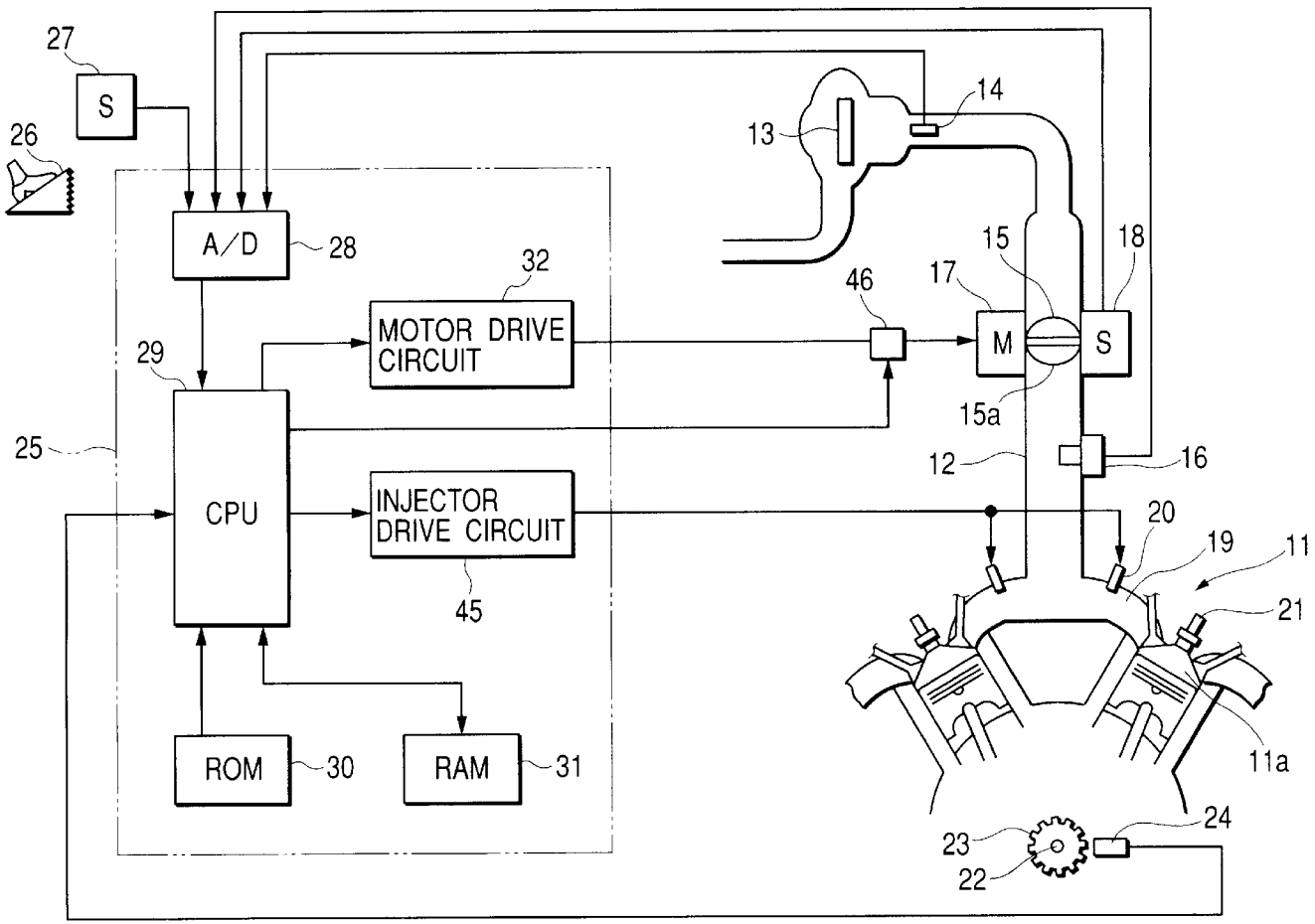
FIG. 1 is a schematic diagram showing an overall arrangement of an engine control system in accordance with a first embodiment of the present invention.

Preferred embodiments of the present invention will be explained hereinafter with reference to attached drawings. Identical parts are denoted by the same reference numerals throughout drawings.

First Embodiment

FIGS. 1 to 19 show a control apparatus for an internal combustion engine in accordance with a first embodiment of the present invention.

FIG. 1 shows a schematic arrangement of a control system for an internal combustion engine 11. An air cleaner 13 is provided at an upstream end of an intake pipe 12 of the engine 11. An airflow meter 14, provided at a downstream side of the air cleaner 13, measures an intake air amount. The airflow meter 14 comprises a hot wire (not shown) disposed in the stream of intake air and an intake temperature sensing element (not shown), and controls electric current supplied to the hot wire to maintain a difference between the temperature of the hot wire and the intake temperature to a constant value. Through this control, the electric current supplied to the hot wire varies in accordance with a heat radiation amount of the hot wire which is responsive to an intake airflow amount. A voltage signal corresponding to the supplied electric current is generated as an intake airflow amount signal.

A throttle valve 15, provided at a downstream side of the airflow meter 14, has a rotational shaft 15*a* connected to a motor 17, such as a DC motor, serving as a throttle actuator. The motor 17 drives the throttle valve 15 to control an opening degree of the throttle valve 15 (i.e., a throttle opening degree). A throttle opening sensor 18 detects the throttle opening degree.

In this case, when the engine is in an idling condition, the motor 17 controls the opening degree of the throttle valve 15 so as to feedback control the engine speed to a target value. This control is generally referred to as an idling speed control (ISC). Regarding a practical arrangement for the idling speed control, it is possible to provide an ISC valve in a bypass passage of the throttle valve 15 and control the opening degree of the ISC valve to adjust a bypass air amount.

An intake pressure sensor 16, provided at a downstream side of the throttle valve 15, detects an intake pressure. An intake manifold 19, located downstream of the throttle valve 15, guides the intake air to each cylinder 1 la of the engine 11. A fuel injector 20, provided in the intake manifold 19, injects fuel into the manifold 19. An ignition plug 21 is attached on a cylinder head of each engine cylinder 11*a*. A signal rotor 23 is coupled on a crank shaft 22 of the engine 22. A crank angle sensor 24, confronting with an outer periphery of the signal rotor 23, generates a pulse signal proportional to a rotational speed of the crank shaft 22. The pulse signal (i.e., an engine speed signal Ne) generated from the crank angle sensor 24 is sent to an electronic control unit (ECU) 25.

An accelerator sensor 27 detects a depression amount of an accelerator pedal 26 and generates a voltage signal representing the detected accelerator depression amount. A/D converter 28 receives the voltage signal of the accelerator sensor 27 and converts it into a digital signal for ECU 25. A/D converter 28 also receives output signals of the airflow sensor 14, the intake pressure sensor 16, the throttle opening sensor 18 and other sensors and converts them into digital signals for ECU 25.

ECU 25, chiefly consisting of CPU 29, ROM 30, and RAM 31 as a microcomputer, executes throttle controls according to various programs stored in ROM 30. In an ordinary throttle control, CPU 29 controls a motor drive circuit 32 based on a target throttle opening degree determined in accordance with an accelerator depression amount. The motor drive circuit 32 performs a feedback control (e.g., PID control) of motor 17 so that an actual opening degree of throttle valve 15 is equalized to the target throttle opening degree.

A safety circuit 46, constituted by a relay circuit or the like, interposes between the motor drive circuit 32 and the motor 17. The safety circuit 46 is responsive to the detection of any abnormal condition of an electronic throttle system, so as to stop supplying electric power to the motor 17 in such an abnormal condition.

Furthermore, CPU 29 executes various routines shown in FIGS. 10 to 18 which are stored in ROM 30. More specifically, in addition to a later-described throttle delay control, CPU 29 predicts a throttle opening degree at the intake valve close timing (i.e., a charged air amount determining timing), then predicts a charged air amount based on the predictive throttle opening degree, and finally calculates a fuel injection amount based on the predictive charged air amount. Thereafter, CPU 29 produces a fuel injection pulse having a pulse width corresponding to the calculated fuel injection amount. An injector driving circuit 45 receives the fuel injection pulse thus produced from CPU 29, and controls an injection time (i.e., a fuel injection amount) of the fuel injector 20.

ECU 25 calculates a fuel injection amount based on the system shown in FIGS. 2 to 9.

Figure 2:
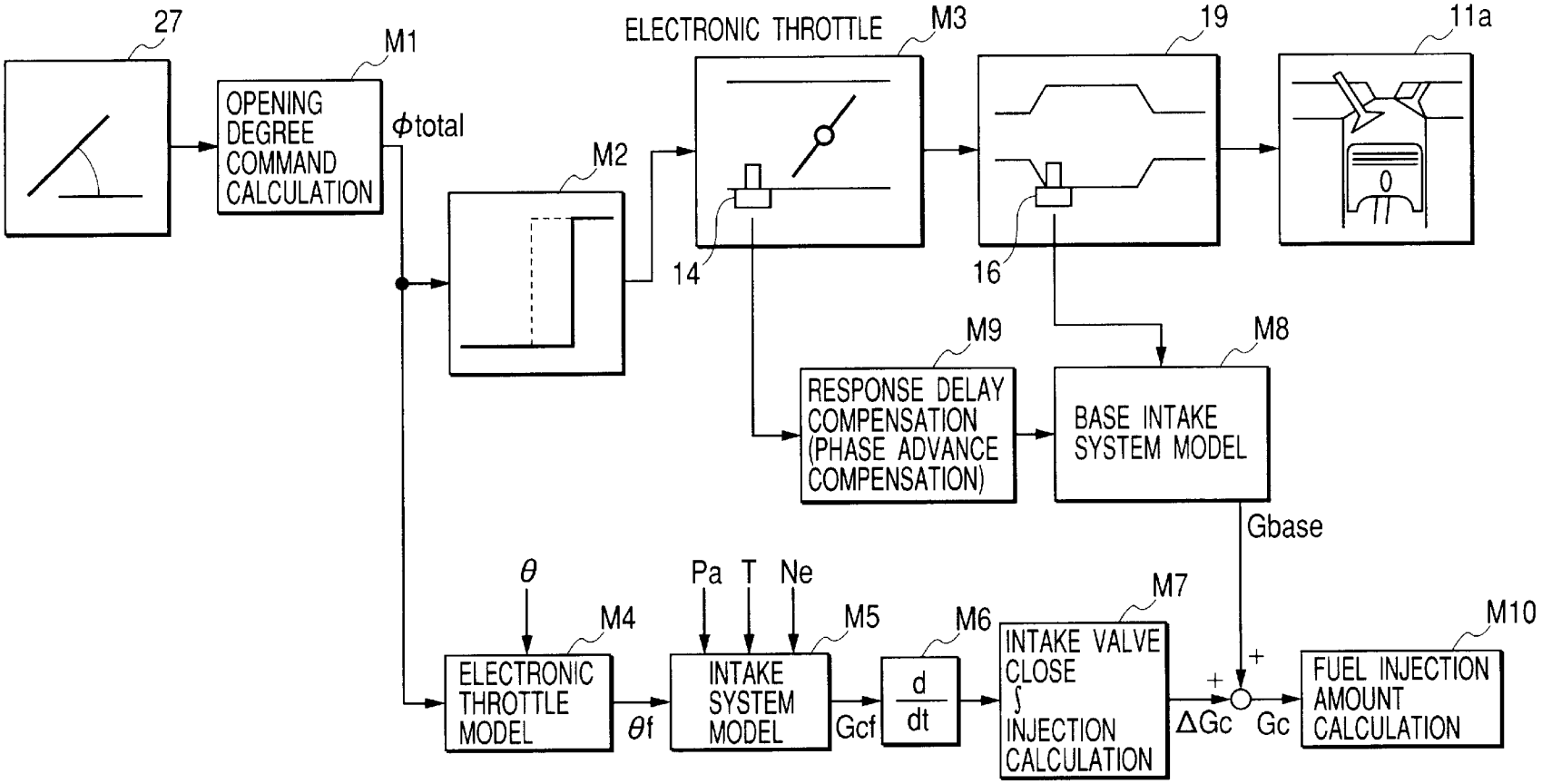
FIG. 2 is a block diagram showing the function of an electronic control unit in accordance with the first embodiment of the present invention.

FIG. 2 is a block diagram schematically showing a charged air amount predicting system in accordance with the first embodiment of the present invention. During an engine operating condition, the accelerator sensor 27 detects an accelerator depression amount. An opening degree command calculating means M1 determines an opening degree command (i.e., a target throttle opening degree) in accordance with the accelerator depression amount with reference to a map or the like. A delay means M2 delays the opening degree command by a predetermined delay time Tdly. The motor drive circuit 32 of the electronic throttle system M3 receives the delayed opening degree command.

Figure 3:
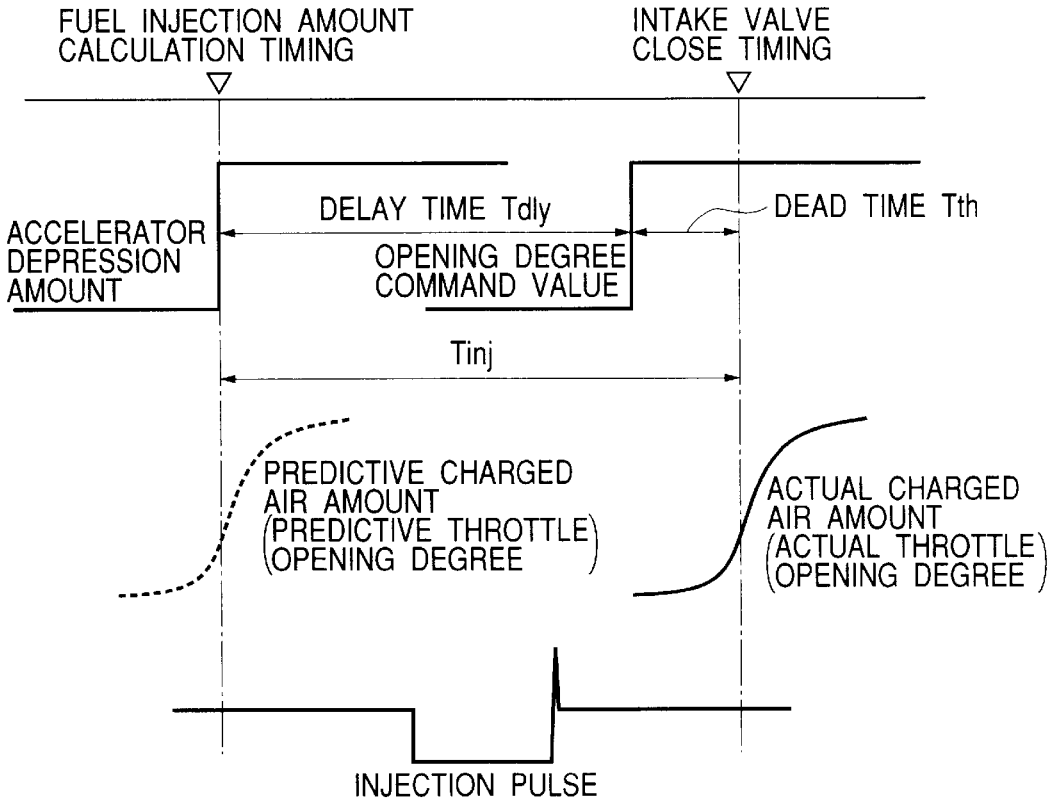
FIG. 3 is a time chart explaining a relationship between a throttle delay control and a predictive charged air amount (i.e., a predictive throttle opening degree) calculating timing in accordance with the first embodiment of the present invention.

As shown in FIG. 3, the delay time Tdly of the opening degree command is expressed by Tdly=Tinj−Tth when Tinj represents a predictive time from a calculating timing of fuel injection amount TAU (i.e., a charged air amount predicting timing) to an intake valve close timing and Tth represents a dead time of the electronic throttle system M3.

The dead time Tth of the electronic throttle system M3 is a constant value irrelevant to a throttle driving speed. On the other hand, the predictive time Tinj decreases with increasing engine speed and may become shorter than the dead time Tth in a high engine speed region.

Considering this relationship, the first embodiment outputs the opening degree command without any delay in a case where the predictive time Tinj becomes shorter than the dead time Tth.

An electronic throttle model M4 receives an opening degree command value $\phi$total being not delayed by the delay means M2.

Figure 4:
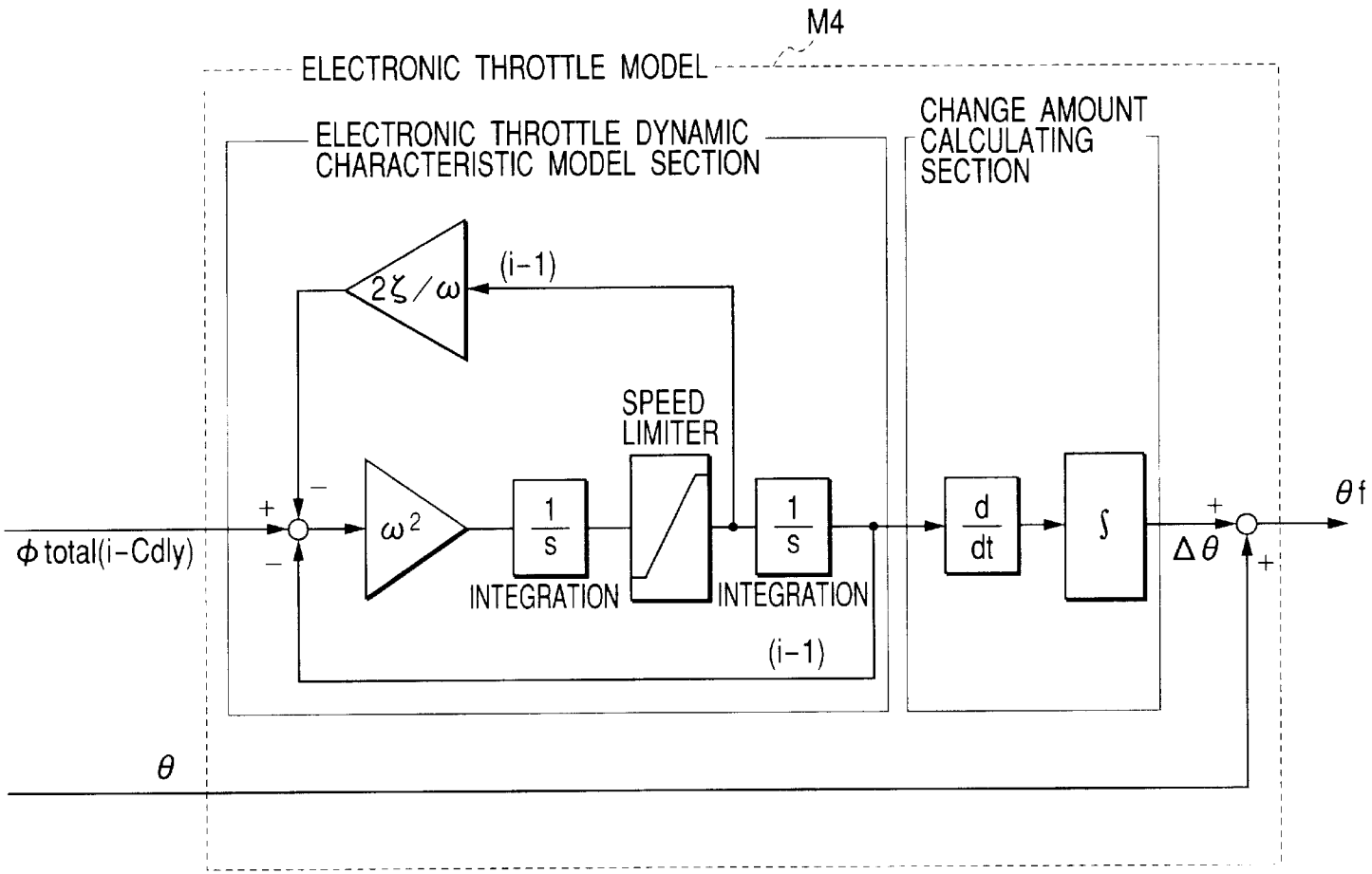
FIG. 4 is a block diagram showing an arrangement of an electronic throttle model in accordance with the first embodiment of the present invention.

FIG. 4 shows a detailed arrangement of the electronic throttle model M4 which chiefly consists of an electronic throttle dynamic characteristic model section and a change amount calculating section.

The electronic throttle dynamic characteristic model section simulates the response delay characteristics of the electronic throttle system M3 as a second-order delay element $[\omega^2/(s^2+2\zeta\omega s+\omega^2)]$, and also simulates the limit characteristics of a drive speed of throttle valve 15 as a speed limiter. The electronic throttle dynamic characteristic model section calculates a predictive throttle opening degree $\theta$f based on the non-delayed opening degree command value $\phi$total. Each of two integral elements (1/s) involved in the second-order delay element is a rectangular integration. It is however possible to use a first-order delay element to simplify the calculation process, instead of using the second-order delay element.

Furthermore, the change amount calculating section of the electronic throttle model M4 comprises a derivative element (d/dt) and an integral element (∫). The derivative element (d/dt) obtains a variation during a sampling time Ts with respect to an output of the electronic throttle dynamic characteristic model section (i.e., a predictive throttle opening degree). Then, the integral element (∫) integrates the obtained variation. Thus, the change amount calculating section calculates a predictive throttle opening change $\Delta\theta$. In this case, the time for integrating the variation by the integral element ($\int$) is a larger one of the predictive time Tinj and the dead time Tth. Thus, the predictive throttle opening change $\Delta\theta$ is a predictive change amount of the throttle opening at the intake valve close timing (or at the termination of dead time Th).

The electronic throttle model M4 adds the predictive throttle opening change $\Delta\theta$ to a present throttle opening degree $\theta$ (i.e., an output of throttle opening sensor 18) to obtains a predictive throttle opening degree $\theta f(\theta f=\theta+\Delta\theta)$. The predictive throttle opening degree $\theta f$ is sent to an intake system model M5.

Figure 5:
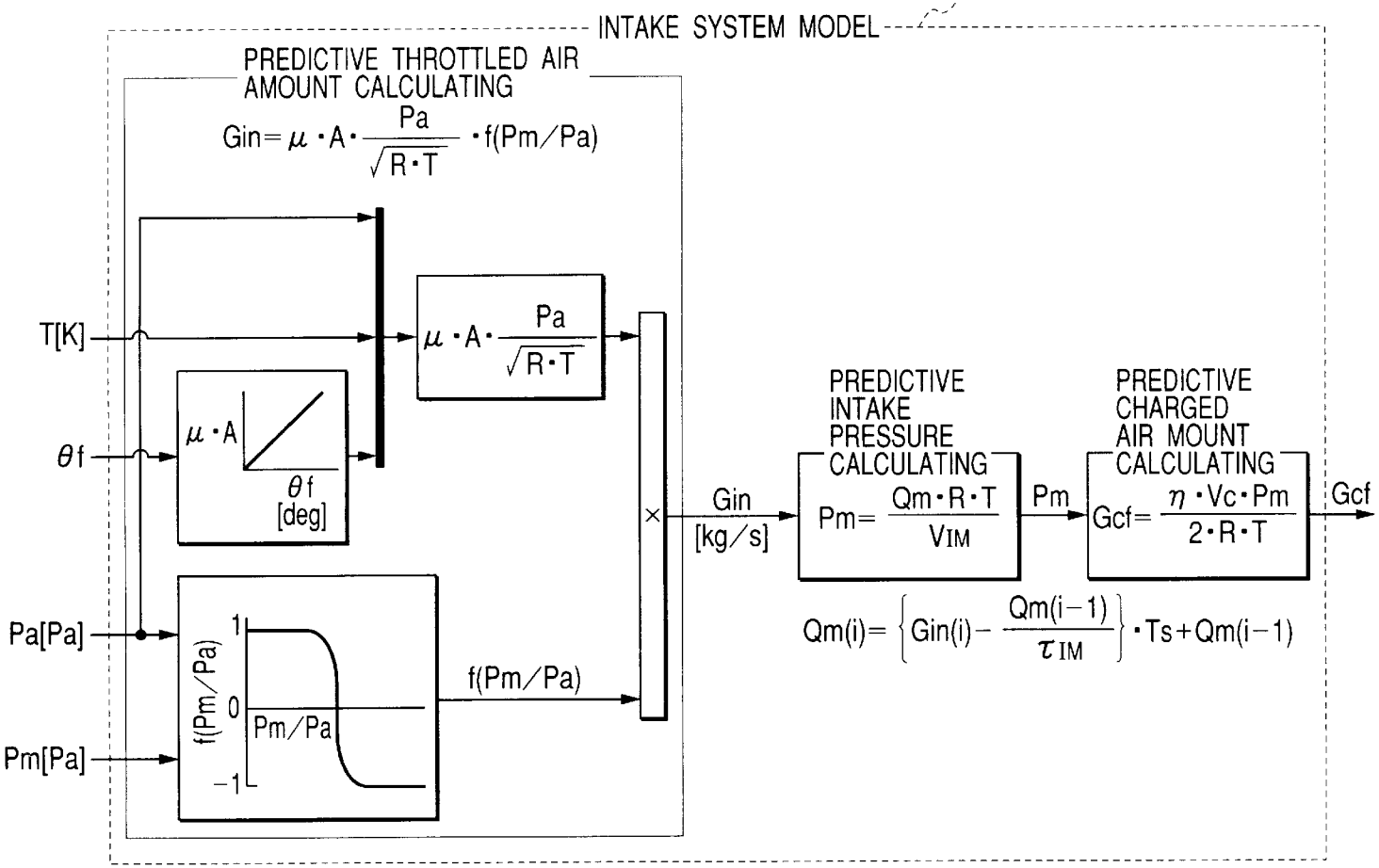
FIG. 5 is a block diagram showing an arrangement of an intake system model in accordance with the first embodiment of the present invention.

FIG. 5 shows a detailed arrangement of the intake system model M5 which chiefly consists of a predictive throttled air amount calculating section, a predictive intake pressure calculating section, and a predictive charged air amount calculating section.

The throttle opening can be regarded as an orifice provided in the intake air passage. The predictive throttled air amount calculating section calculates a predictive air amount passing through the throttle valve 15 (i.e., a predictive throttled air amount Gin) based on the predictive throttle opening degree. The predictive intake pressure calculating section calculates a predictive intake pressure Pm based on the predictive throttled air amount Gin. The predictive charged air amount calculating section calculates an air amount charged into an engine cylinder 11*a* (i.e., a predictive charged air amount) Gcf based on the predictive intake pressure Pm.

The predictive throttled air amount calculating section is represented by the following orifice expression.

$$Gin = \mu \cdot A \cdot \frac{Pa}{\sqrt{R \cdot T}} \cdot f(Pm/Pa) \tag{1}$$

Gin: throttled air amount [kg/sec]

$\mu$: flow coefficient

A: effective cross-sectional area of throttle opening [$m^2$]

Pa: atmospheric pressure [Pa]

Pm: intake pressure [Pa]

R: gas constant

T: intake temperature [K]

$$A=\pi r^2(1-\cos^2\theta) \tag{2}$$

r: radius of throttle valve [m]

$\theta$: throttle opening degree in case of $$Pm \le \left(\frac{2}{\kappa+1}\right)^{\frac{\kappa}{\kappa-1}} \cdot Pa \tag{3}$$

$$f(Pm/Pa) = \sqrt{\frac{2\kappa}{\kappa+1}\left(\frac{2}{\kappa+1}\right)^{\frac{\kappa}{\kappa-1}}}$$

In case of $$Pm > \left(\frac{2}{\kappa+1}\right)^{\frac{\kappa}{\kappa-1}} \cdot \mathrm{Pa} \tag{4}$$

-continued $$f(Pm/Pa) = \sqrt{\frac{2\kappa}{\kappa-1}\left\{\left(\frac{Pm}{Pa}\right)^{\frac{2}{\kappa}} - \left(\frac{Pm}{Pa}\right)^{\frac{\kappa+1}{\kappa}}\right\}}$$

$\kappa$: ratio of specific heat

Figure 6:
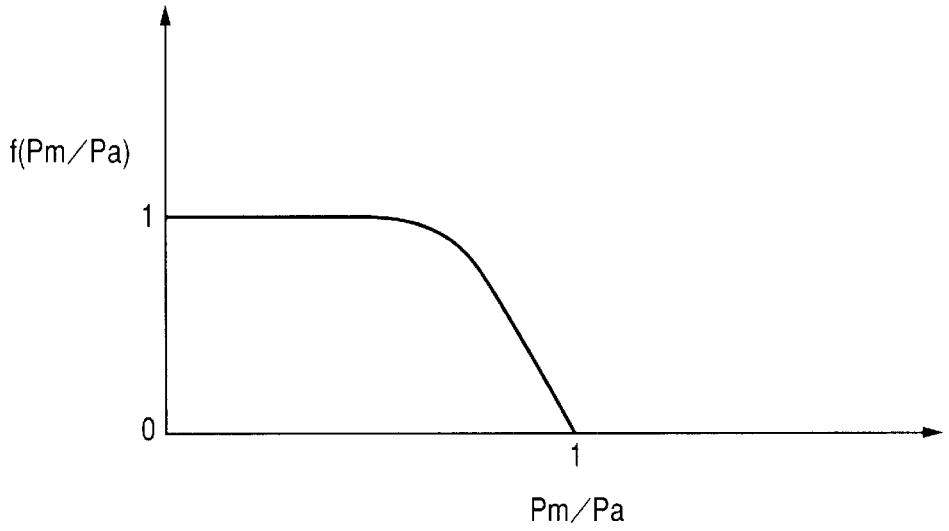
FIG. 6 is a graph schematically showing a table of f(Pm/Pa)

It is desirable to calculate f(Pm/Pa) according to the above expressions. However, to simplify the calculation, it is possible to use a predetermined table with a parameter Pm/Pa to calculate f(Pm/Pa). FIG. 6 shows a practical table of f(Pm/Pa) which is normalized with respect to a maximum value 1.

As apparent from the above expressions (3) and (4), f(Pm/Pa) is physically a non-negative value. According to the example shown in FIG. 6, f(Pm/Pa) is set to 0 when Pm/Pa>1.

However, setting f(Pm/Pa)=0 in the region Pm/Pa>1 possibly causes a hunting phenomenon (refer to FIG. 8) of the throttled air amount Gin, the predictive intake pressure Pm, or the predictive charged air amount Gcf during a high load operating condition (i.e., when Pm/Pa is in the vicinity of 1). This is believed because a change rate of f(Pm/Pa) becomes large when Pm/Pa is in the vicinity of 1. Every time when the calculated value Pm/Pa becomes equal to or larger than 1, f(Pm/Pa) is guarded at 0. Thus, the change of f(Pm/Pa) becomes irregular during the high load operating condition.

Figure 7:
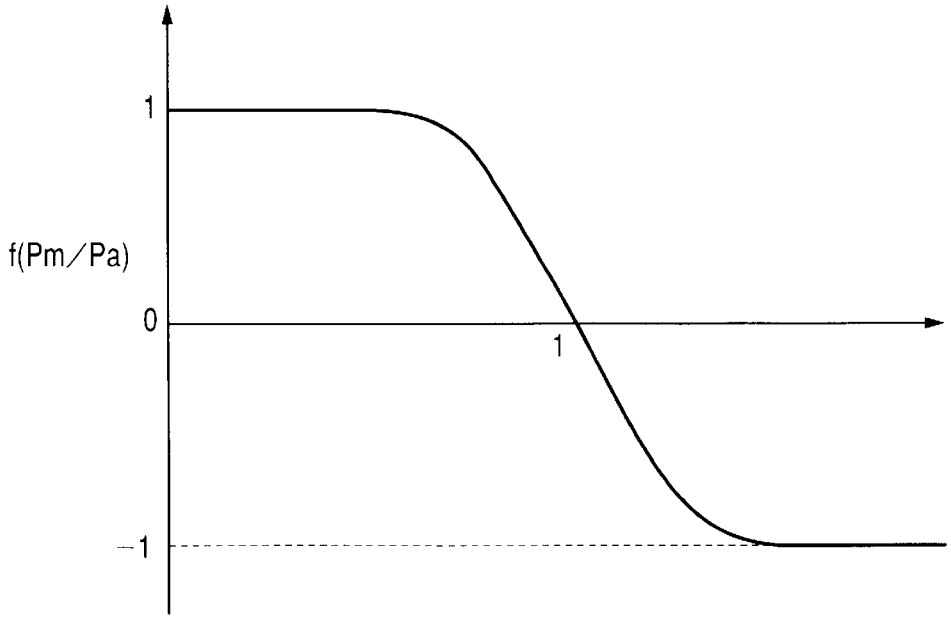
FIG. 7 is a graph schematically showing another table of f(Pm/Pa)
Figure 8:
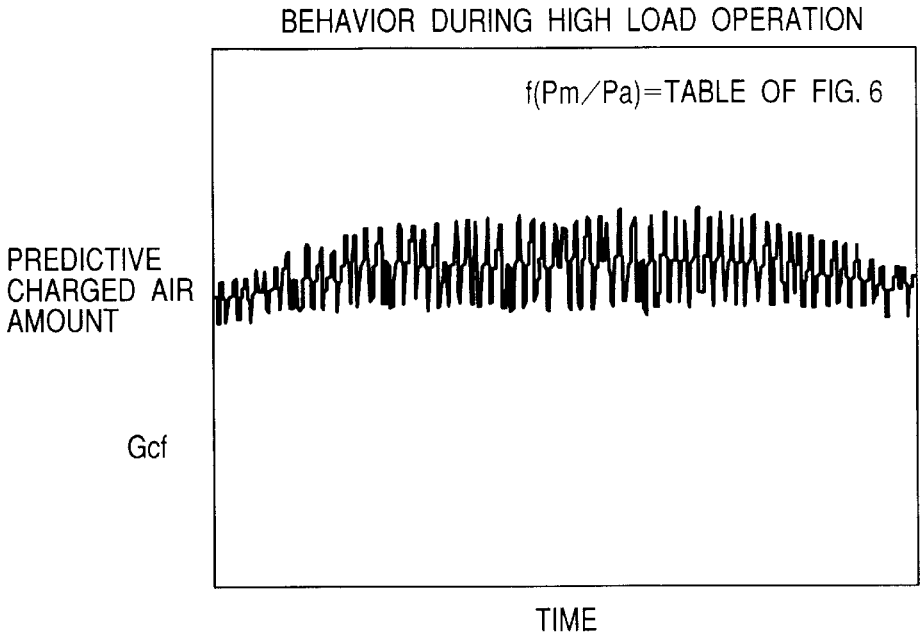
FIG. 8 is a graph showing the behavior of a predictive charged air amount Gcf during a high load condition calculated based on the table of f(Pm/Pa) shown in FIG. 6.

To eliminate this problem, this embodiment use a table of f(Pm/Pa) shown in FIG. 7.

Namely, f(Pm/Pa)=a positive value when Pm/Pa<1 f(Pm/Pa)=0 when Pm/Pa=1 f(Pm/Pa)=a negative value when Pm/Pa>1

According to this setting, f(Pm/Pa) has symmetric change characteristics with respect to the point Pm/Pa=1. The sign (±) of f(Pm/Pa) inverts at the point Pm/Pa=1.

Figure 9:
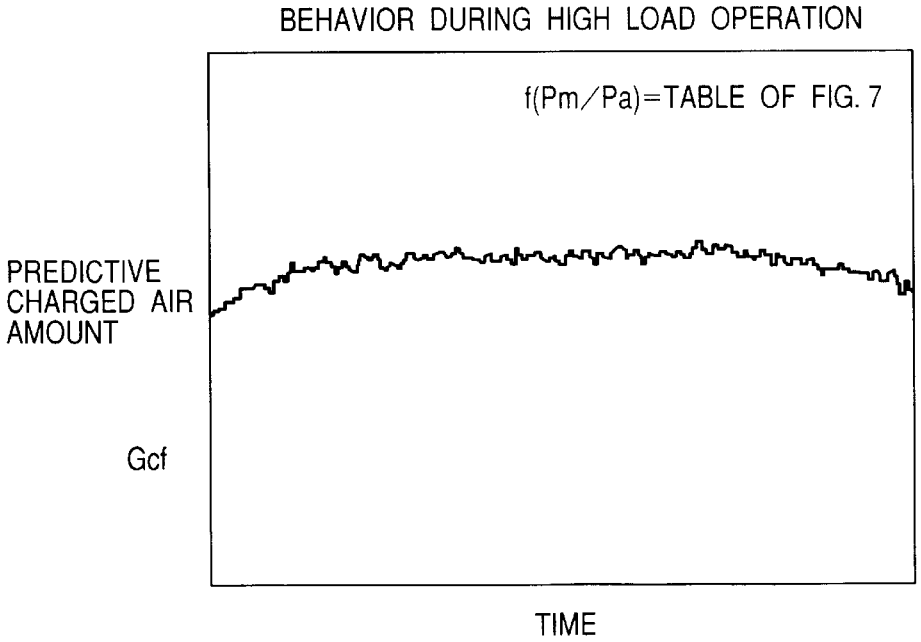
FIG. 9 is a graph showing the behavior of a predictive charged air amount Gcf during a high load condition calculated based on the table of f(Pm/Pa) shown in FIG. 7.

Using the table of FIG. 7 makes it possible to regulate the change of f(Pm/Pa) during the high load operating condition (i.e., when Pm/Pa is in the vicinity of 1). An output of the intake system model MS (i.e., the predictive charged air amount Gcf) during the high load operating condition can be stabilized by averaging the calculated value of the intake system model (i.e., throttled air amount Gin, predictive intake pressure Pm, or predictive charged air amount Gcf) as shown in FIG. 9. This prevents the hunting phenomenon.

The intake pressure Pm entered into the predictive throttled air amount calculating section is a previous predictive intake pressure Pm(i−1) calculated in the predictive intake pressure calculating section. However, an output of the intake pressure sensor 16 can be used as intake pressure Pm.

The effective cross-sectional area A of throttle opening, used in the calculation of the predictive throttled air amount Gin, can be calculated by entering the throttle opening degree $\theta$ into the above expression (2). However, to simplify the calculation, the first embodiment uses a table with a parameter of a predictive throttle opening degree to obtain a multiplication value $\mu \cdot A$.

Next, the predictive intake pressure Pm and the predictive charged air amount Gcf are calculated in the following manner.

The following relationship is derived when the law of mass conservation is applied to the flow of intake air flowing in an intake passage connecting from the throttle valve 15 to an intake port of the engine 11 (hereinafter referred to as "throttle downstream intake passage").

$$d/dt \cdot Gm = Gin - Gcf \quad (5)$$

where Qm represents an air amount in the throttle downstream intake passage, d/dt·Gm represents a change of the air amount in the throttle downstream intake passage, Gin represents the predictive throttled air amount, and Gcf represents the predictive charged air amount.

Furthermore, the following relationship is derived when the equation of gas state is applied to the throttle downstream intake passage.

$$Gcf = \eta \cdot (Ne/2) \cdot Vc \cdot (Qm/V_{IM}) \quad (6)$$

η: volumetric efficiency

Ne: engine speed

Vc: cylinder volume $V_{IM}$: volume of throttle downstream intake passage

The volumetric efficiency η is variable depending on an intake air flow amount. According to this embodiment, volumetric efficiency η is obtained from a predetermined map defined by engine speed Ne and intake pressure Pm which are the parameters correlating with the intake air flow amount. The intake pressure Pm used in this case is a previous predictive intake pressure Pm(i−1).

$\eta = f\ (Ne, Pm)$

Furthermore, the time constant $\tau_{IM}$ of the intake system model M5 is defined by the following expression.

$$\tau_{IM} = 2 \cdot V_{IM}/(Vc \cdot \eta \cdot Ne) \quad (7)$$

The following relationship is derived from the above expressions (5) to (7).

$$d/dt \cdot Qm = Gin - Qm/\tau_{IM} \quad (8)$$

As the above expression (8) is an equation of continuity, it can be converted into the following discrete equation.

$$\{Qm(i) - Qm(i-1)\}/Ts = Gin(i) - Qm(i-1)/\tau_{IM} \quad (9)$$

where Ts is a sampling time.

The above equation (9) can be modified in the following manner to derive the air amount Qm in the throttle downstream intake passage.

$$Qm(i) = \{Gin(i) - Qm(i-1)/\tau_{IM}\} \cdot Ts + Qm(i-1)[\mathrm{kg}] \quad (10)$$

Furthermore, the following relationship is derived when the equation of gas state is applied to the throttle downstream intake passage.

$$Pm = Qm \cdot R \cdot T/V_{IM}\ [Pa] \quad (11)$$

R: gas constant

T: intake temperature

The predictive intake pressure calculating section of the intake system model M5 obtains the predictive intake pressure Pm based on the above equations (10) and (11).

The following relationship is derived from the above equations (11) and (6) to obtain the predictive charged air amount Gcf.

$$Gcf = \eta \cdot Vc \cdot Pm/(2 \cdot R \cdot T)[kg/rev] \quad (12)$$

The predictive charged air amount calculating section of the intake system model M5 obtains a provisional predictive charged air amount Gcf according to the expression (12).

As shown in FIG. 2, the output of the intake system model M5 (i.e., the provisional predictive charged air amount Gcf) is entered into a derivative element M6 (d/dt) to obtain a variation during the sampling time Ts. The obtained variation during each sampling time Ts is integrated in an integral element M7 (∫) during the predictive time Tinj from the calculating timing of fuel injection amount TAU (i.e., charged air amount predicting timing) to the intake valve close timing.

The integrated value in the integral element M7 (∫) is equivalent to a predictive change ΔGc of the charged air amount at the intake valve close timing. The predictive change ΔGc is added to a base charged air amount Gbase calculated by a base intake system model M8 to obtain a final predictive charged air amount Gc (i.e., a charged air amount determined at the intake valve close timing).

Next, the method for calculating the base charged air amount will be explained.

The base charged air amount is a present air amount charged into the engine cylinder 11*a* which is calculated based on an output of the airflow meter 14 (i.e., intake airflow amount). Therefore, the base charged air amount does not include a change of charged air amount caused by a change of throttle opening degree. In general, the method for calculating the charged air amount based on the output of airflow meter 14 is accurate in a stationary state because the intake air flow amount correctly reflects the charged air amount. However, in a transient state, the measuring accuracy of charged air amount by the airflow meter 14 will be worsened due to delay of airflow meter 14.

In view of this problem, the first embodiment provides a response delay compensating element M9 (i.e., phase advance compensating element) to improve the response of airflow meter 14 during a transient state. An output of the response delay compensating element M9 is supplied o the base intake system model M8 to produce the base charged air amount Gbase. The transfer function of the base intake system model M8 is expressed by the following first-order delay equation.

$$Gbase = 1/(1 + \tau_{IM} \cdot s) \cdot Gdlay$$

Gbase: base charged air amount

Gdlay: output of response delay compensating element $\tau_{IM}$: time constant

The time constant $\tau_{IM}$ of the base intake system model M8 is defined by the following expression.

$$\tau_{IM} = 2 \cdot V_{IM}/(Vc \cdot \eta \cdot Ne)$$

$V_{IM}$: volume of throttle downstream intake passage

Vc: cylinder volume

η: volumetric efficiency

Ne: engine speed

The volumetric efficiency η is variable depending on an intake air flow amount. According to this embodiment, volumetric efficiency η is obtained from a predetermined map defined by engine speed Ne and intake pressure P (i.e., an output of intake pressure sensor 16) which are the parameters correlating with the intake air flow amount.

The base charged air amount Gbase calculated by the base intake system model M8 is added to the predictive change ΔGc of the charged air amount calculated based on the predictive throttle opening or the like to obtain the final predictive charged air amount Gc (i.e., the charged air amount determined at the intake valve close timing). Then, a fuel injection amount calculating means M10 calculates the fuel injection amount TAU in accordance with the final predictive charged air amount Gc and the engine speed or the like.

The control routines shown in FIGS. 10 through 18 show the operations of functional blocks shown in FIG. 2.

<Maim Routine>

Figure 10:
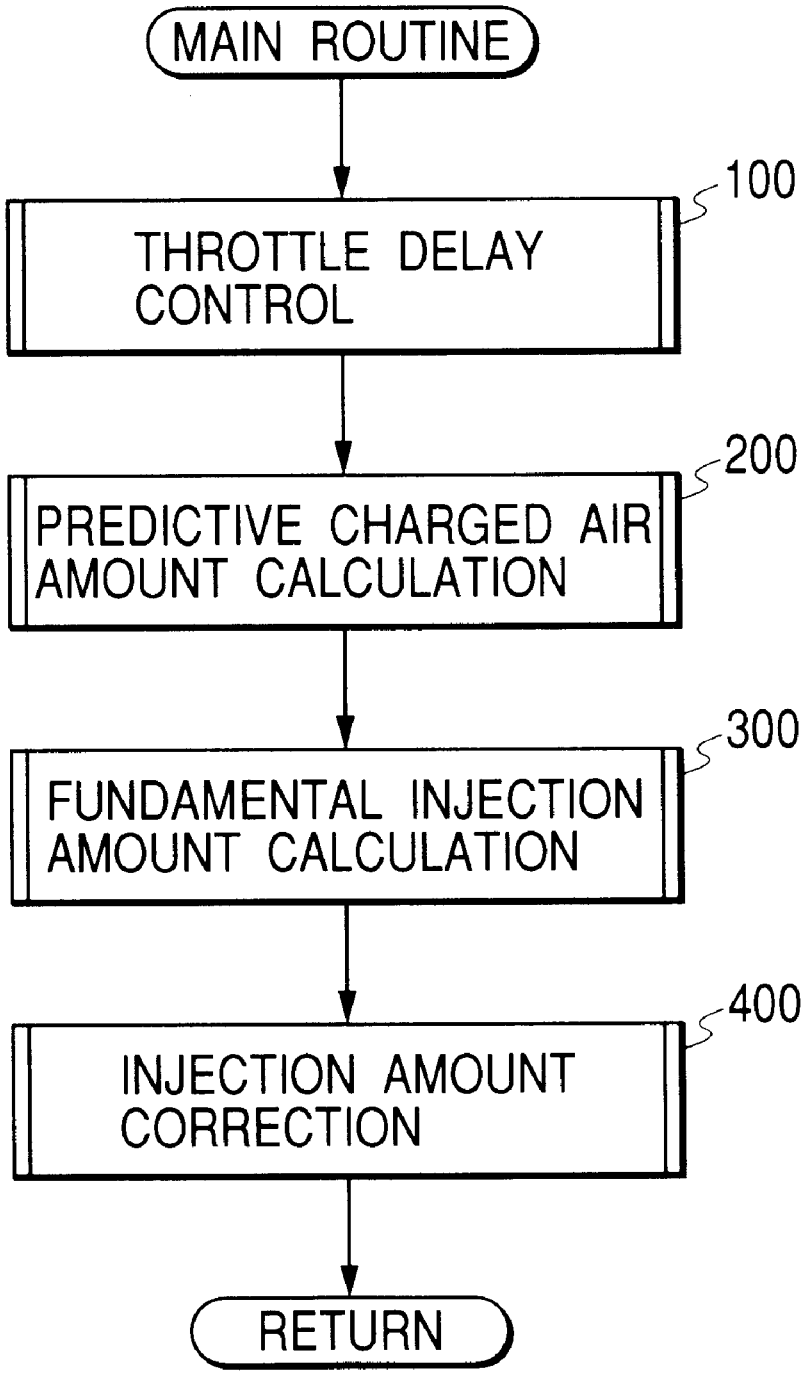
FIG. 10 is a flowchart showing a main routine performed in the electronic control unit in accordance with the first embodiment of the present invention.

FIG. 10 shows a main routine performed in CPU 29 in accordance with the first embodiment of the present invention, which is performed at a predetermined cycle since an ignition switch is turned on.

First, in step 100, CPU 29 executes a throttle delay control routine which is later described with reference to the flowchart shown in FIG. 11. In this throttle delay control routine, the opening degree command value ϕtotal being set according to the accelerator depression amount is delayed by a predetermined delay time Tdly. Next, in step 200, CPU 29 executes a predictive charged air amount calculating routine which is later described with reference to the flowchart shown in FIG. 12. In this predictive charged air amount calculating routine, the predictive charged air amount Gc is calculated.

Next, in step 300, CPU 29 executes a fundamental injection amount calculating routine. In this fundamental injection amount calculating routine, a fundamental injection amount Tp is calculated in accordance with the predictive charged air amount Gc and the engine speed Ne with reference to a map or the like.

Next, in step 400, CPU 29 executes an injection amount correcting routine which is later described with reference to the flowchart shown in FIG. 18. In this injection amount correcting routine, a final fuel injection amount is obtained by multiplying the fundamental injection amount Tp with a fuel correction coefficient Kload relating to a load change (i.e., an acceleration/deceleration correcting coefficient) and other correction coefficient Kc including an air-fuel ratio feedback correction coefficient and a cooling water correction coefficient.

<Throttle Delay Control Routine>

Figure 11:
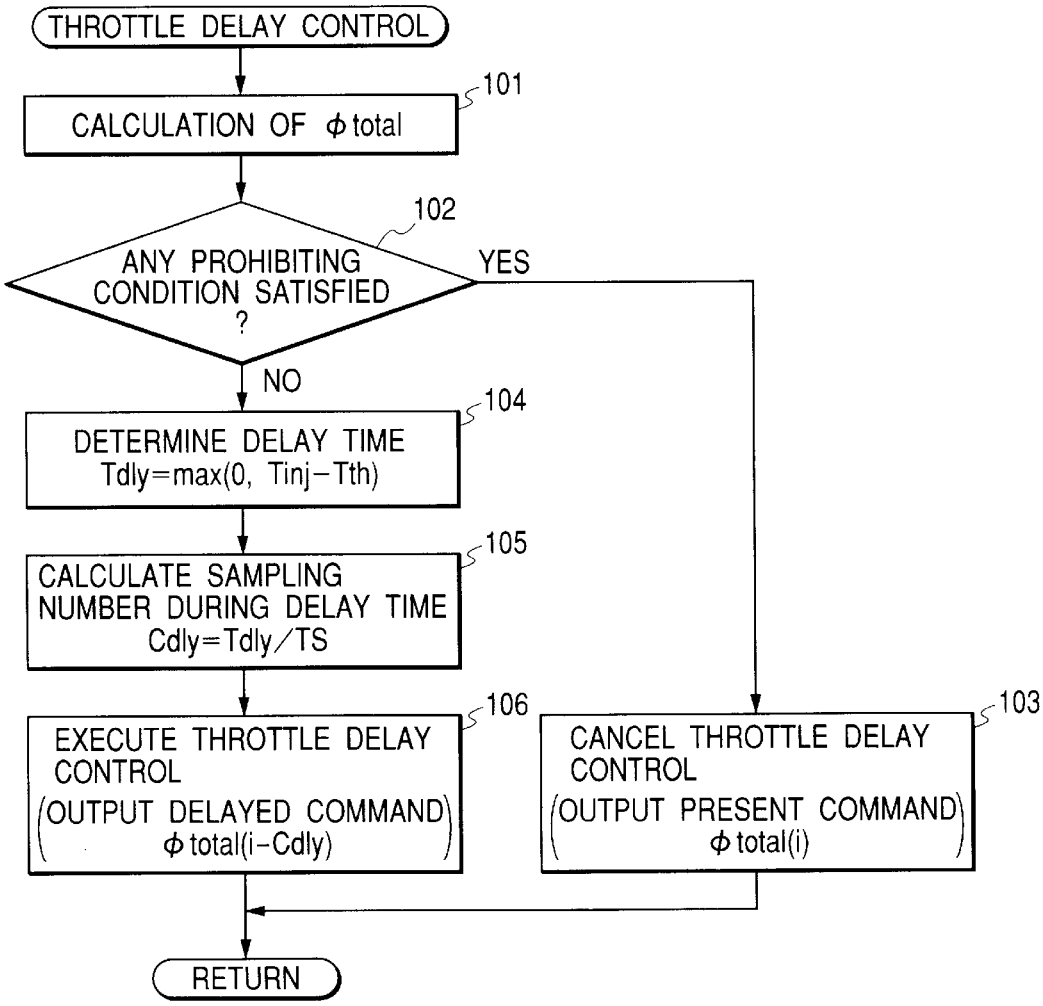
FIG. 11 is a flowchart showing a throttle delay control routine performed in the electronic control unit in accordance with the first embodiment of the present invention.

FIG. 11 shows the details of the throttle delay control routine executed in the step 100 shown in FIG. 10.

First in step 101, CPU 29 determines an opening degree command value ϕtotal in accordance with an accelerator depression amount (i.e., an output of accelerator sensor 27) or the like.

In this case, the opening degree command value ϕtotal is obtained as a sum of a required opening degree ϕpedal according to the accelerator depression amount and a required opening degree ϕisc necessary for the idling speed control (ISC).

$$\phi total = \phi pedal + \phi isc$$

Next, in step 102, CPU 29 makes a judgement as to whether or not any prohibiting condition is satisfied with respect to the throttle delay control.

The following is practical prohibiting conditions of the throttle delay control:

① a predetermined time has not elapsed since the engine operation is started;

② the engine is in an idling condition or an accelerator depression amount is small; and ③ an automatic transmission is in a neutral condition.

When any one of the above three conditions is satisfied, the throttle delay control is prohibited. In other words, the throttle delay control is executed only when all of the above three conditions are simultaneously satisfied.

In general, immediately after the engine operation is started, the engine operating condition is unstable. If the throttle delay control is forcibly executed, the engine speed will fluctuate largely. Furthermore, the throttle delay control possibly interferes with the idling speed control. The idling speed will become unstable. When the automatic transmission is in a neutral condition, the engine usually race in response to a depression of an accelerator pedal. A driver may test the response of an engine through the racing. However, if the throttle delay control is performed during the neutral condition, the driver will feel that this engine has bad response.

In view of the above, the first embodiment prohibits the throttle delay control in the specific engine operating conditions (on or immediately after the engine startup, during the idling speed control, and during neutral condition) so as to eliminate any adverse influence brought by the throttle delay control.

When any prohibiting condition is satisfied (i.e., YES in step 102), the control flow proceeds to step 103 to cancel the throttle delay control. In this case, CPU 29 produces a present (i.e., latest) opening degree command value ϕtotal (i) to the motor drive circuit 32 without any delay.

When none of the prohibiting conditions are satisfied (i.e., NO in step 102), the control flow proceeds to step 104 to perform the throttle delay control.

In step 104, CPU 29 determines a delay time Tdly of the opening degree command value ϕtotal. As shown in FIG. 3, the delay time Tdly is expressed by Tdly=Tinj−Tth when Tinj represents the predictive time from the calculating timing of fuel injection amount TAU (i.e., the charged air amount predicting timing) to the intake valve close timing and Tth represents the dead time of the electronic throttle system M3.

When the predictive time Tinj is shorter than the dead time Tth (Tinj<Tth), the delay time Tdly is set to 0.

Next, in step 105, CPU 29 calculates a sampling number Cdly during the delay time Tdly according to the following expression.

$$Cdly = Tdly / Ts$$

where Ts represents a sampling time.

Next, in step 106, CPU 29 executes the throttle delay control. In this case, CPU 29 produces a previous opening degree command value ϕtotal (i−Cdly), which is calculated earlier (=corresponding to sampling number Cdly) than the present command value, to the motor drive circuit 32 without any delay. Thus, the output timing of the opening degree command value ϕtotal is delayed by an amount equivalent to the delay time Tdly.

<Predictive Charged Air Amount Calculating Routine>

Figure 12:
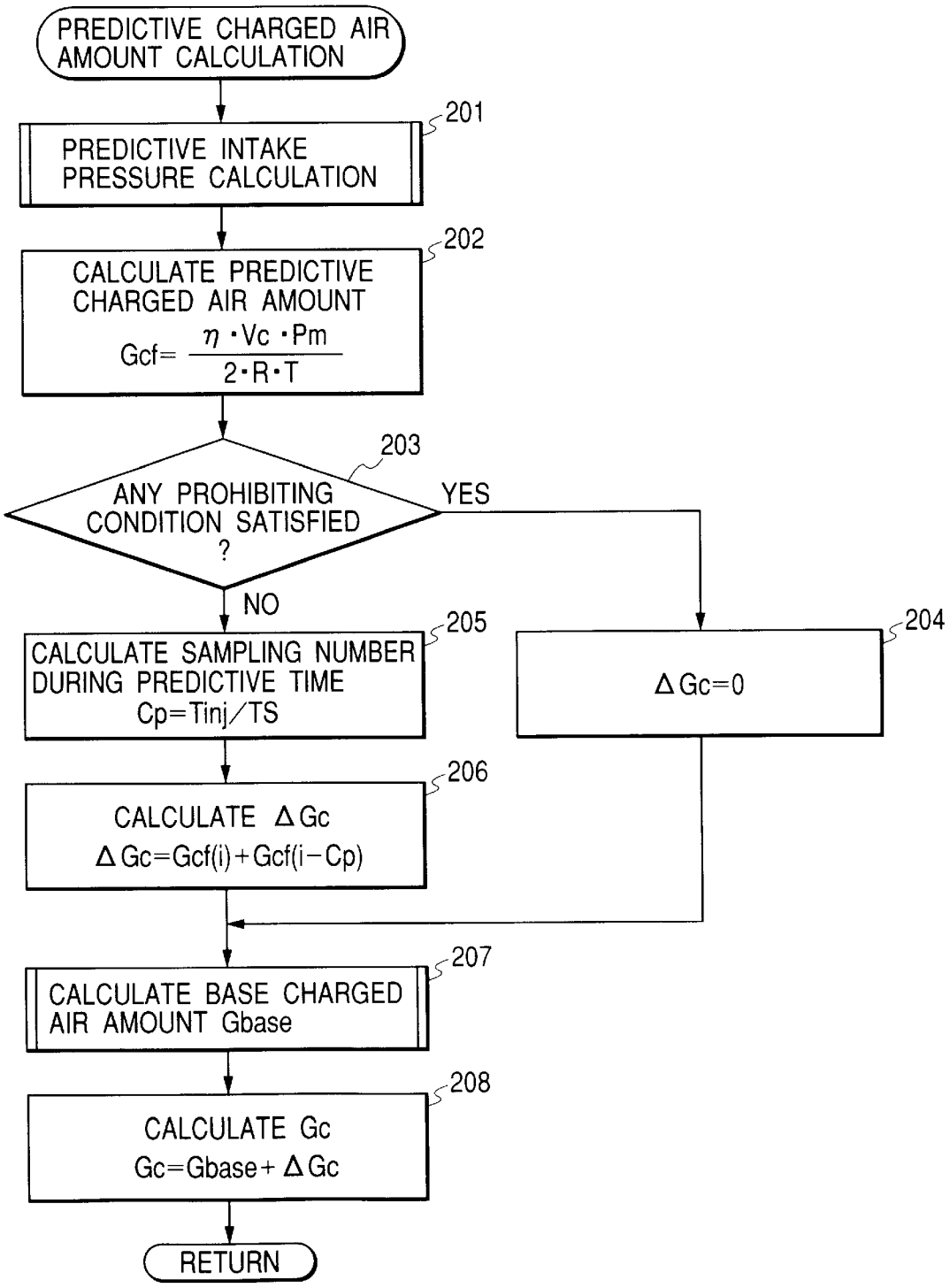
FIG. 12 is a flowchart showing a predictive charged air amount calculating routine performed in the electronic control unit in accordance with the first embodiment of the present invention.

FIG. 12 shows the details of the predictive charged air amount calculating routine executed in the step 200 shown in FIG. 10.

First in step 201, CPU 29 executes a predictive intake pressure calculating routine, which is later described with reference to the flowchart shown in FIG. 13, to calculate a predictive intake pressure Pm (i.e., an intake pressure at the intake valve close timing).

Next, in step 202, CPU 29 calculates a predictive charged air amount Gcf(i) based on the predictive intake pressure Pm according to the following expression.

$$Gcf(i) = \eta \cdot Vc \cdot Pm / (2 \cdot R \cdot T)\ [kg/rev]$$

η: volumetric efficiency

Vc: cylinder volume

R: gas constant

T: intake temperature

Next, in step S203, CPU 29 makes a judgement as to whether or not any prohibiting condition is satisfied with respect to the throttle delay control (refer to the detailed description of step 102 shown in FIG. 11).

When any prohibiting condition is satisfied (i.e., YES in step 203), the control flow proceeds to step 203 to cancel the throttle delay control. In this case, CPU 29 sets the predictive change ΔGc to 0, where ΔGc is a predictive change amount of the charged air amount during the predictive time Tinj from the fuel injection amount calculating timing to the intake valve close timing.

When none of the prohibiting conditions are satisfied (i.e., NO in step 203), the throttle delay control is performed according to the routine shown in FIG. 11 and then the control flow proceeds to step 205.

In step 205, CPU 29 calculates a sampling number Cp during the predictive time Tinj according to the following expression.

$$Cp=Tinj/Ts$$

where predictive Tinj represents a period of time from the fuel injection amount calculating timing (i.e., the charged air amount predicting timing) to the intake valve close timing, and Ts represents a sampling time.

Next, in step 206, CPU 29 calculates a predictive change ΔGc according to the following expression.

$$\Delta Gc=Gcf(i)+Gcf(i-Cp)$$

where Gcf(i) represents a present predictive charged air amount (i.e., a predictive charged air amount calculated at the intake valve close timing), and Gcf(i−Cp) represents a previous predictive charged air amount calculated at an earlier timing (=corresponding to sampling number Cp) (i.e., a predictive charged air amount calculated at the fuel injection amount calculating timing).

After completing the step 204 or step 206, the control flow proceeds to step 207 to calculate the base charged air amount Gbase. In this case, the response delay compensating element (i.e., by the phase advance compensating element) compensates the output of airflow meter 14. The base charged air amount Gbase is calculated based on the output Gdlay of the response delay compensating element according to the following transfer function.

$$Gbase=1/(1+\tau_{IM}\cdot s)\cdot Gdlay$$

where $\tau_{IM}$ represents a time constant of the base intake system model M8.

To simplify the explanation, the transfer function is expressed as an equation of continuity for calculating the charged air amount. However, ECU 25 calculates the base charged air amount Gbase by using a discrete equation converted from the above equation.

Then, in step 208, CPU 29 calculates the predictive charged air amount Gc according to the following expression.

$$Gc=Gbase+\Delta Gc$$

<Predictive Intake Pressure Calculating Routine>

Figure 13:
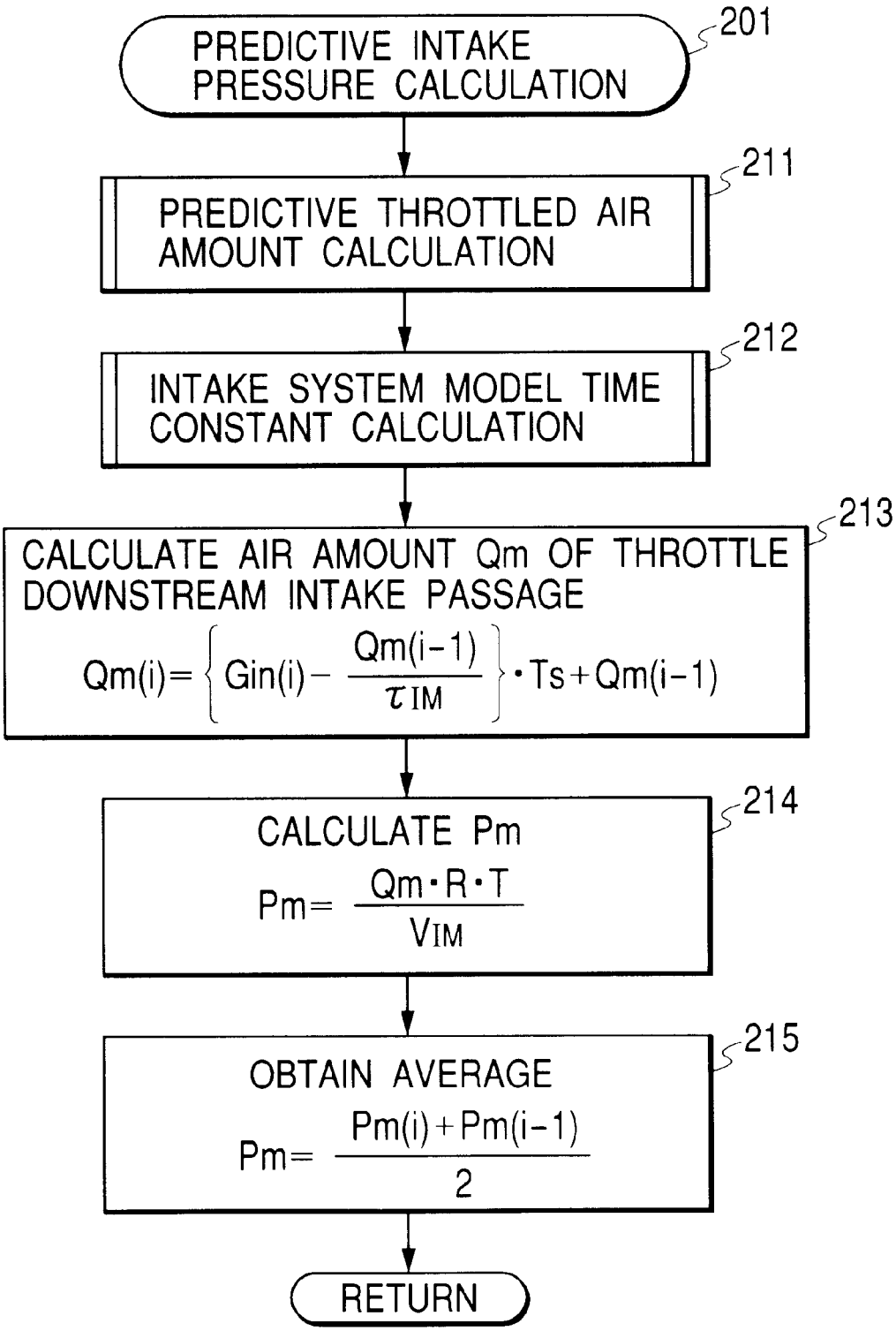
FIG. 13 is a flowchart showing a predictive intake pressure calculating routine performed in the electronic control unit in accordance with the first embodiment of the present invention.

FIG. 13 shows the details of the predictive intake pressure calculating routine executed in the step 201 shown in FIG. 12.

First in step 211, CPU 29 executes a predictive throttled air amount calculating routine, which is later described with reference to the flowchart shown in FIG. 14, to calculate the predictive throttled air amount Gin.

Next, in step 212, CPU 29 executes an intake system model time constant calculating routine, which is later described with reference to the flowchart shown in FIG. 16, to calculate the time constant $\tau_{IM}$ of the intake system model.

Then, in step 213, CPU 213 calculates the air amount Qm in the throttle downstream intake passage according to the following expression.

$$Qm(i)=\{Gin(i)-Qm(i-1)\ \tau_{IM}\}\cdot Ts+Qm(i-1)$$

where Qm(i) represents a present air amount in the throttle downstream intake passage calculated at the present cycle, Qm(i−1) represents a previous air amount in the throttle downstream intake passage calculated at the previous cycle, and Ts represents a sampling time.

Then, in step 214, CPU calculates the predictive intake passage Pm based on the air amount Qm in the throttle downstream intake passage according to the following expression.

$$Pm=Qm\cdot R\cdot T/V_{IM}$$

where R represents the gas constant, T represents the intake temperature, and $V_{IM}$ represents a volume of the throttle downstream intake passage.

Then, in step 215, CPU 29 obtains an average of the predictive intake pressure according to the following expression.

$$Pm=\{Pm(i)+Pm(i-1)\}/2$$

where Pm(i) is a present predictive intake pressure calculated at the present cycle, and Pm(i−1) is a previous predictive intake pressure calculated at the previous cycle.

<Predictive Throttled Air Amount Calculating Routine>

Figure 14:
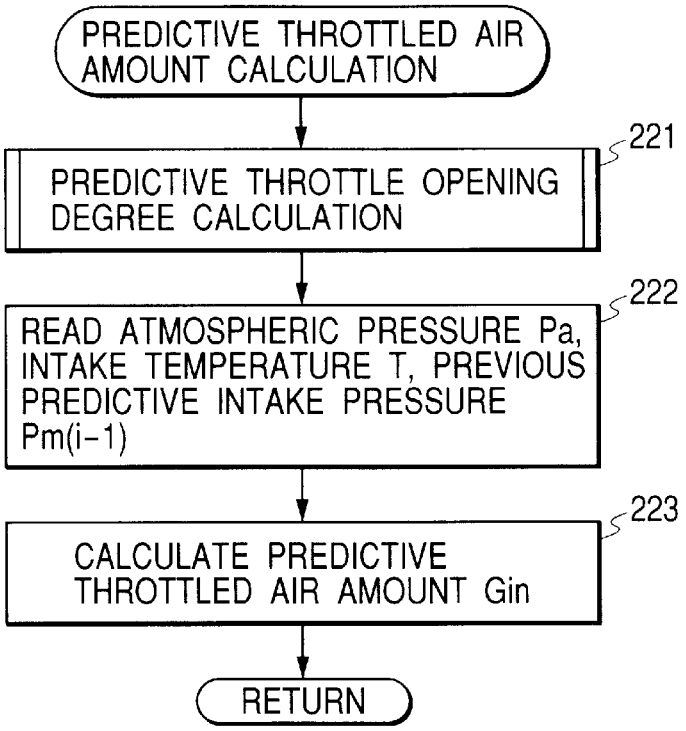
FIG. 14 is a flowchart showing a predictive throttled air amount calculating routine performed in the electronic control unit in accordance with the first embodiment of the present invention.

FIG. 14 shows the details of the predictive throttled air amount calculating routine executed in the step 211 shown in FIG. 13.

First in step 221, CPU 29 executes a predictive throttle opening degree calculating routine, which is later described with reference to the flowchart shown in FIG. 15, to calculate the predictive throttle opening degree θf at the intake valve close timing.

Next, in step 222, CPU 29 reads the atmospheric pressure Pa, the intake temperature T, and the previous predictive intake pressure Pm(i−1).

Then, in step 223, CPU 29 calculates the predictive throttled air amount Gin according to the following expression.

$$Gin=\mu\cdot A\cdot\frac{Pa}{\sqrt{R\cdot T}}\cdot f(Pm/Pa)$$

Gin: throttled air amount [kg/sec]

$\mu$: flow coefficient

A: effective cross-sectional area of throttle opening [$m^2$]

Pa: atmospheric pressure [Pa]

Pm: intake pressure [Pa]

R: gas constant

T: intake temperature [K]

f(Pm/Pa): physical value determined based on a ratio of Pm to Pa

In this case, $\mu\cdot A$ is calculated from a table with a parameter of the predictive throttle opening degree θf, and f(Pm/Pa) is calculated from the table shown in FIG. 7. The intake pressure Pm is obtained from the previous predictive intake pressure Pm(i−1). Both of the atmospheric pressure Pa and the intake temperature T are obtained from respective sensors. It is possible to fix the atmospheric pressure Pa to a standard atmospheric pressure (i.e., a fixed value).

<Predictive Throttle Opening Degree Calculating Routine>

Figure 15:
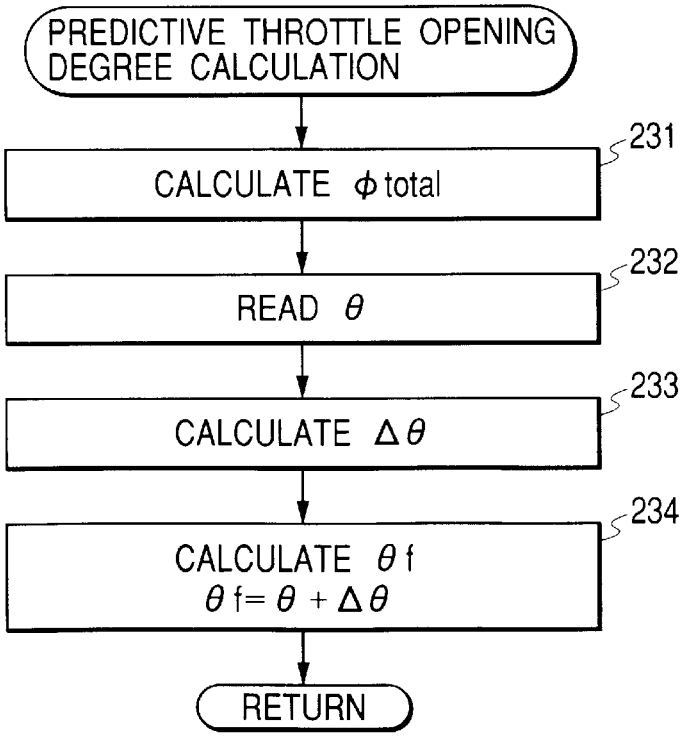
FIG. 15 is a flowchart showing a predictive throttle opening degree calculating routine performed in the electronic control unit in accordance with the first embodiment of the present invention.

FIG. 15 shows the details of the predictive throttle opening degree calculating routine executed in the step 221 shown in FIG. 14.

First in step 231, CPU 29 calculates the opening degree command value ϕtotal according to the accelerator depression amount. In this case, the opening degree command value ϕtotal is obtained as a sum of a required opening degree ϕpedal according to the accelerator depression amount and a required opening degree ϕisc necessary for the idling speed control (ISC).

$$\phi total=\phi pedal+\phi isc$$

Then, in step 232, CPU 29 reads a present throttle opening degree θ detected by the throttle opening sensor 18.

Then, in step 233, CPU 29 calculates the predictive throttle opening change Δθ based on the non-delayed opening degree command value ϕtotal, as explained with reference to the electronic throttle dynamic characteristic model section and the change amount calculating section of the electronic throttle model M4 shown in FIG. 4. The predictive throttle opening Δθ is a predictive change amount of the throttle opening degree during the predictive time Tinj from the calculating timing of fuel injection amount TAU (i.e., the charged air amount predicting timing) to the intake valve close timing. When the predictive time Tinj is shorter than the dead time Tth of the electronic throttle system M3, CPU 29 obtains the predictive throttle opening change Δθ during the dead time Tth.

Then, in step 234, CPU 29 calculates the predictive throttle opening degree θf by adding the present throttle opening degree θ and the predictive throttle opening change Δθ.

$$\theta f=\theta+\Delta\theta$$

The predictive throttle opening degree θf is a predictive throttle opening degree at the intake valve close timing (or at the termination of dead time Tth).

<Intake System Model Time Constant Calculating Routine>

Figure 16:
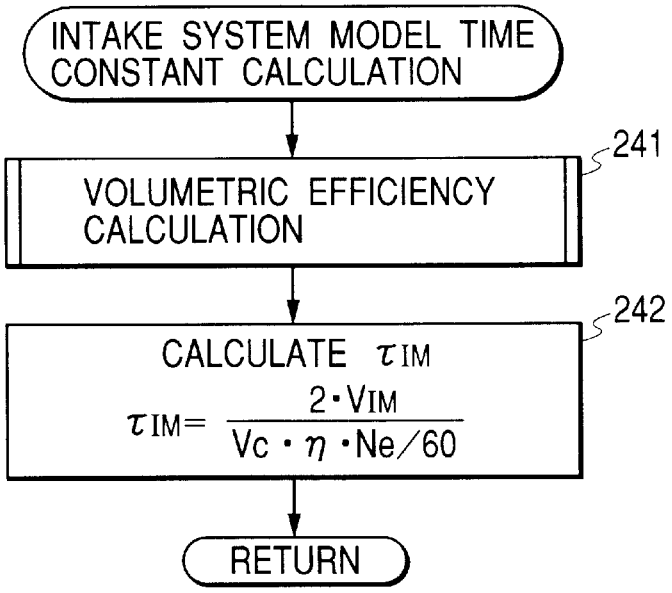
FIG. 16 is a flowchart showing an intake system model time constant calculating routine performed in the electronic control unit in accordance with the first embodiment of the present invention.

FIG. 16 shows the details of the intake system model time constant calculating routine executed in the step 212 shown in FIG. 13.

First in step 241, CPU 29 executes a volumetric efficiency calculating routine, which is later described with reference to the flowchart shown in FIG. 17, to calculate the volumetric efficiency η.

Next, in step 242, CPU 29 calculates the time constant $\tau_{IM}$ of the intake system model according to the following expression.

$$\tau_{IM}=2\cdot V_{IM}/(Vc\cdot\eta\cdot Ne/60)$$

where $V_{IM}$ represents the volume of throttle downstream intake passage, Vc represents the cylinder volume (fixed value), and Ne represents the engine speed (rpm).

<Volumetric Efficiency Calculating Routine>

Figure 17:
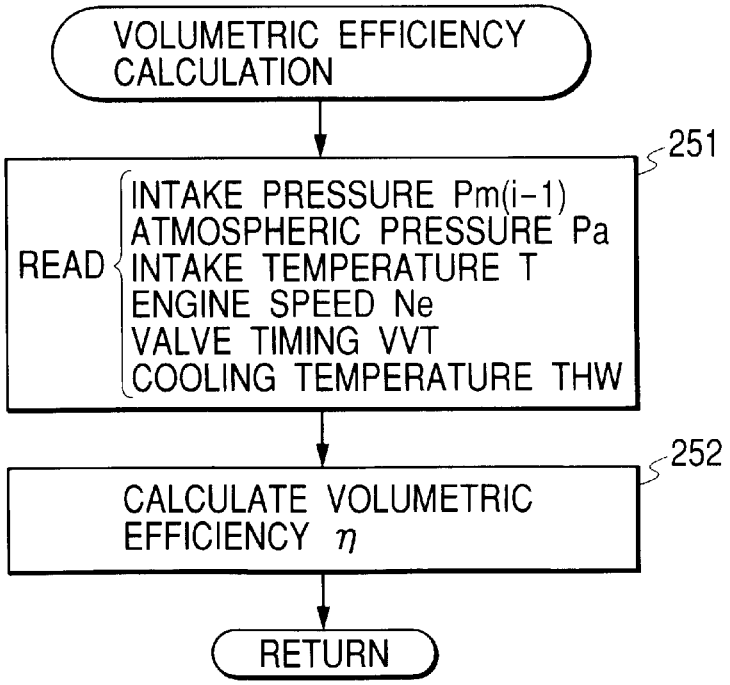
FIG. 17 is a flowchart showing a volumetric efficiency calculating routine performed in the electronic control unit in accordance with the first embodiment of the present invention.

FIG. 17 shows the details of the volumetric efficiency calculating routine executed in the step 241 shown in FIG. 16.

First in step 251, CPU 29 reads the previous intake pressure Pm(i−1), the atmospheric pressure Pa, the intake temperature T, the engine speed Ne, the valve timing VVT, and the cooling water temperature THW.

Next, in step 252, CPU 29 calculates a fundamental volumetric efficiency ηr in accordance with the present engine operating conditions with reference to a predetermined volumetric efficiency map with the parameters of Pm/Pa, Ne, and VVT. Then, CPU 29 corrects the calculated fundamental volumetric efficiency ηr with a correction factor relating to the cooling water temperature THW, thereby finally obtaining the volumetric efficiency η.

<Injection Amount Correcting Routine>

Figure 18:
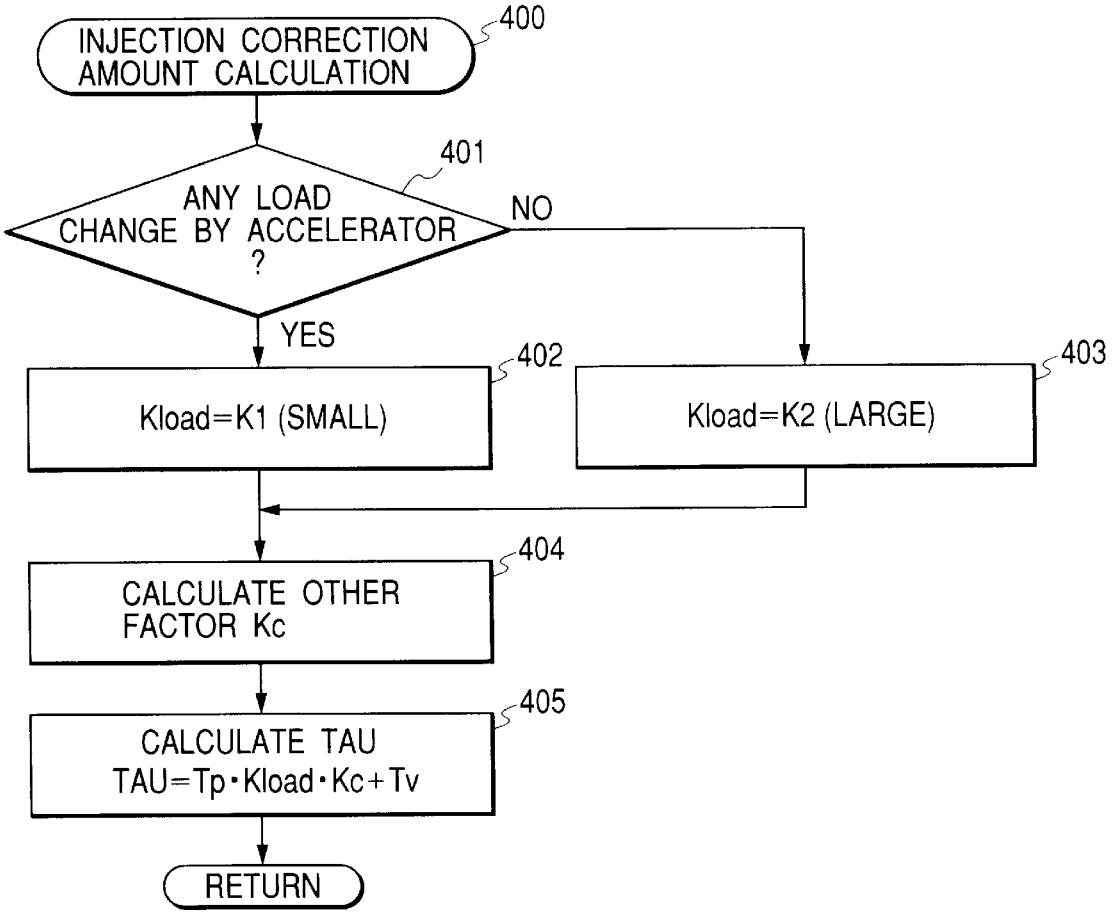
FIG. 18 is a flowchart showing an injection amount correcting routine performed in the electronic control unit in accordance with the first embodiment of the present invention.

FIG. 18 shows the details of the injection amount correcting routine executed in the step 400 shown in FIG. 10.

First in step 401, CPU 29 makes a judgement as to whether or not any load change (i.e., any variation of charged air amount) is caused by an accelerator. In practice, CPU 29 checks whether or not the accelerator depression amount is equal to or larger than a predetermined angle, or whether or not a change of the accelerator is equal to or larger than a predetermined value.

When any load change is caused by the accelerator (i.e., YES in step 401), the control flow proceeds to step 402 wherein CPU 29 sets a smaller fuel correction factor Kload, i.e., Kload=K1 (small), for correcting a detected load change. The above-described charged air amount calculating method of the first embodiment makes it possible to accurately predict a load change caused by the accelerator depression. This is why a smaller fuel correction factor is used for the load change relating to the accelerator depression.

On the other hand, when any load change irrelevant to the accelerator is caused (i.e., NO in step 401), the control flow proceeds to step 403 wherein CPU 29 sets a larger fuel correction factor Kload, i.e., Kload=K2 (large), for correcting a detected load change.

For example, an automatic transmission causes a significant load change during a shift operation from a neutral range to a drive range. Similarly, a power steering device, a braking system, and an air-conditioning apparatus cause load changes. Such load changes are not predictable based on the accelerator depression. This is why a larger fuel correction factor is used for the load changed not relating to the accelerator depression.

After completing the step 402 or step 403, the control flow proceeds to step 404 wherein CPU 29 calculates other fuel correction factor Kc (including an air-fuel feedback correction factor, a cooling water temperature correction factor, and a learning correction factor) which is not related to the load change.

Then, in step 405, CPU 29 calculates a final fuel injection amount TAU based on the fundamental injection amount Tp, the fuel correction factors Kload, Kc, and an invalid injection time Tv according to the following expression.

$$TAU=Tp\times Kload\times Kc+Tv$$

Figure 19:
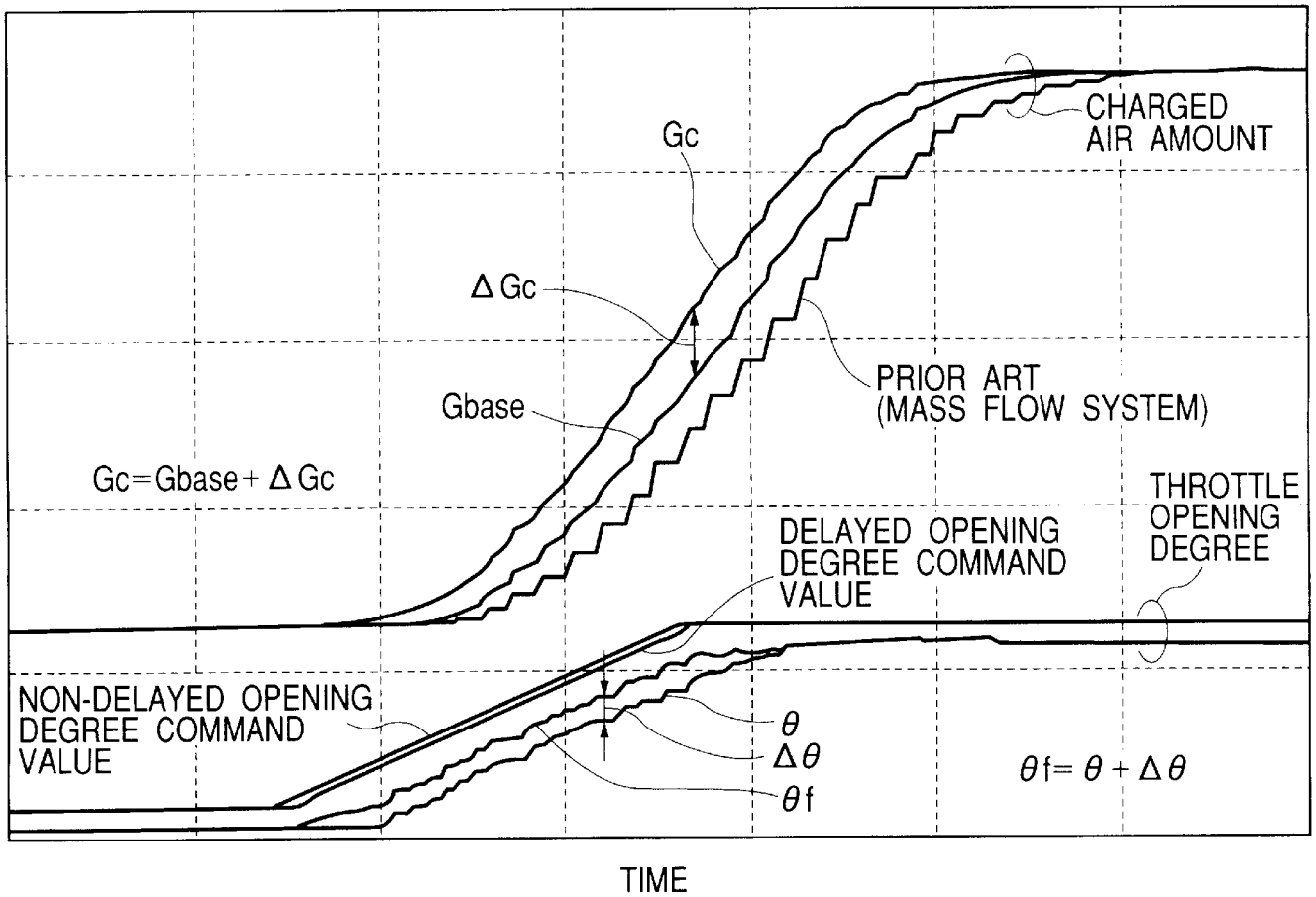
FIG. 19 is a time chart showing the behavior of a predictive throttle opening degree and a predictive charged air amount during an accelerating condition calculated based on the model in accordance with the first embodiment of the present invention.

FIG. 19 is a time chart showing the behavior of the predictive throttle opening degree and the predictive charged air amount calculated by the above-described routines.

During the engine operating condition, the opening degree command value ϕtotal is set in accordance with the accelerator depression amount. An output timing of the opening degree command value ϕtotal is delayed by the delay time Tdly. As shown in FIG. 3, the delay time Tdly is expressed by Tdly=Tinj−Tth when Tinj represents the predictive time from the calculating timing of fuel injection amount TAU (i.e., the charged air amount predicting timing) to the intake valve close timing and Tth represents the dead time of the electronic throttle system M3. When the predictive time Tinj is shorter than the dead time Tth (Tinj<Tth), the delay time Tdly is set to 0.

The predictive throttle opening change Δθ is calculated based on the non-delayed opening degree command value ϕtotal by using the electronic throttle model M4 shown in FIG. 4. Then, the predictive throttle opening change Δθ is added to the present throttle opening degree θ (i.e., the output of throttle opening sensor 18) to obtain the predictive throttle opening degree θf at the intake valve close timing (or at the termination of dead time Tth).

Next, the provisional predictive charged air amount Gcf is calculated based on the predictive throttle opening degree θf by using the intake system model M5 shown in FIG. 5. Then, the predictive change ΔGc of the charged air amount at the intake valve close timing is calculated by derivative and integral processing the provisional predictive charged air amount Gcf until the intake valve close timing. Then, the predictive change ΔGc is added to the base charged air amount Gbase calculated by the base intake system model M8 to obtain the final predictive charged air amount Gc (i.e., the charged air amount determined at the intake valve close timing). Thus, the first embodiment of the present invention can accurately predict the air amount charged into the engine cylinder and improve the accuracy in the air-fuel ratio control during a transient state.

Second Embodiment

Figure 20:
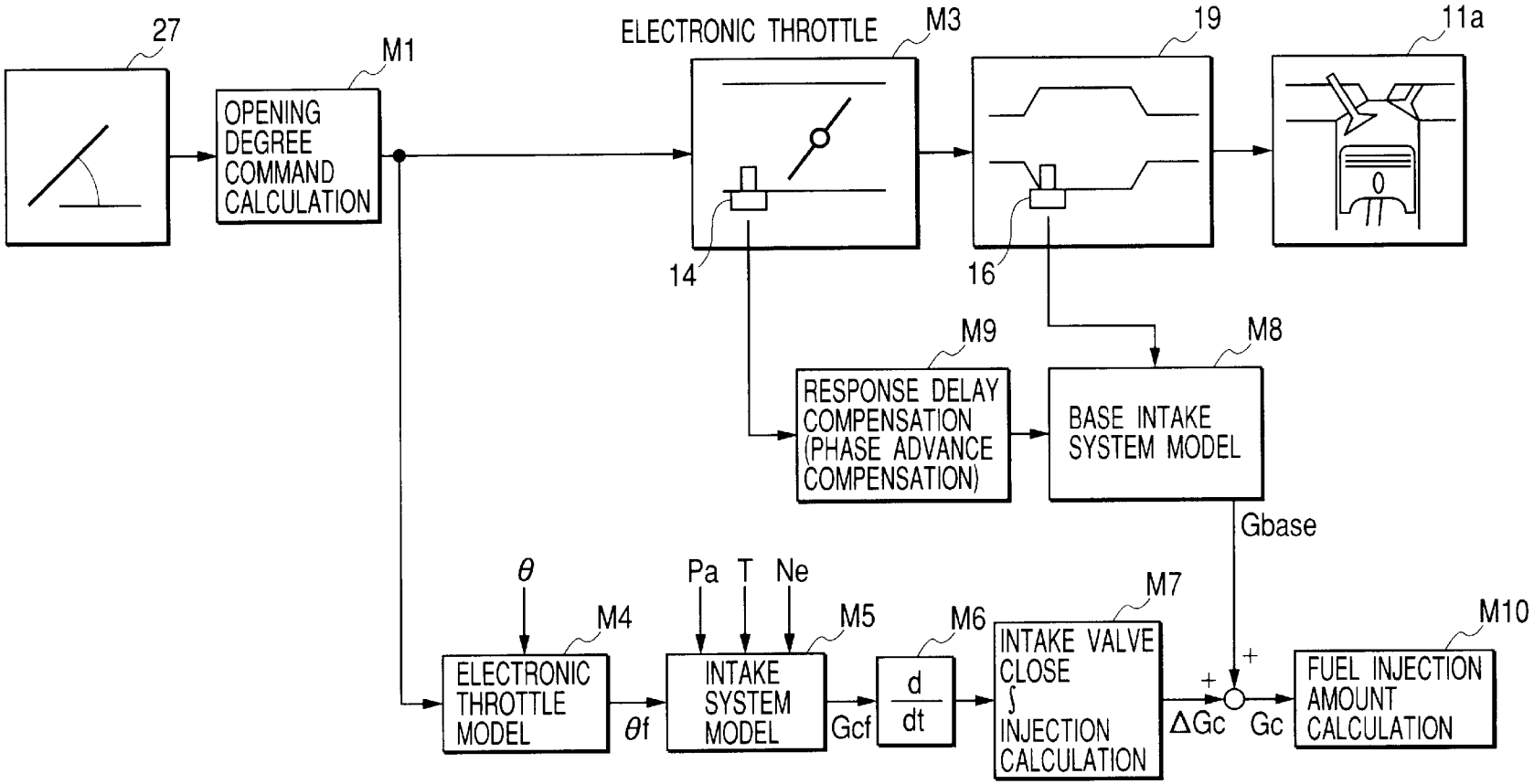
FIG. 20 is a block diagram showing the function of an electronic control unit in accordance with a second embodiment of the present invention.

FIG. 20 is a block diagram schematically showing a charged air amount predicting system in accordance with a second embodiment of the present invention. The system shown in FIG. 20 is similar to that shown in FIG. 2 but different in that the delay means M2 is removed and therefore no throttle delay control is performed. Instead, the second embodiment utilizes the dead time Tth of the electronic throttle system M3 to predict the throttle opening degree.

According to the second embodiment, the opening degree command calculating means M1 determines the opening degree command (i.e., the target throttle opening degree) in accordance with the accelerator depression amount and then sends the opening degree command directly to the motor drive circuit 32 without any delay.

Then, in the same manner as the first embodiment, the electronic throttle model M4 obtains a predictive throttle opening degree at the intake valve close timing (or at the termination of dead time Tth) based on the opening degree command and the present throttle opening degree (i.e., the output of throttle opening sensor 18). The intake system model MS (having the arrangement shown in FIG. 5) calculates a provisional predictive charged air amount based on the predictive throttle opening degree. Then, the provisional predictive charged air amount is subjected to the derivative and integral processing to calculates a predictive change of the charged air amount at the intake valve close timing (or at the termination of dead time Tth). Then, the predictive change of the charged air amount is added with the base charged air amount calculated by the base intake system model M8, thereby finally obtaining a predictive charged air amount.

As apparent from the foregoing description, the second embodiment makes it possible to predict a throttle opening degree based on the dead time Tth of the electronic throttle system M3 and therefore makes it possible to accurately predict the charged air amount based on the predictive throttle opening degree. Thus, it becomes possible to improve the air-fuel control accuracy during a transient state.

Third Embodiment

Figure 21:
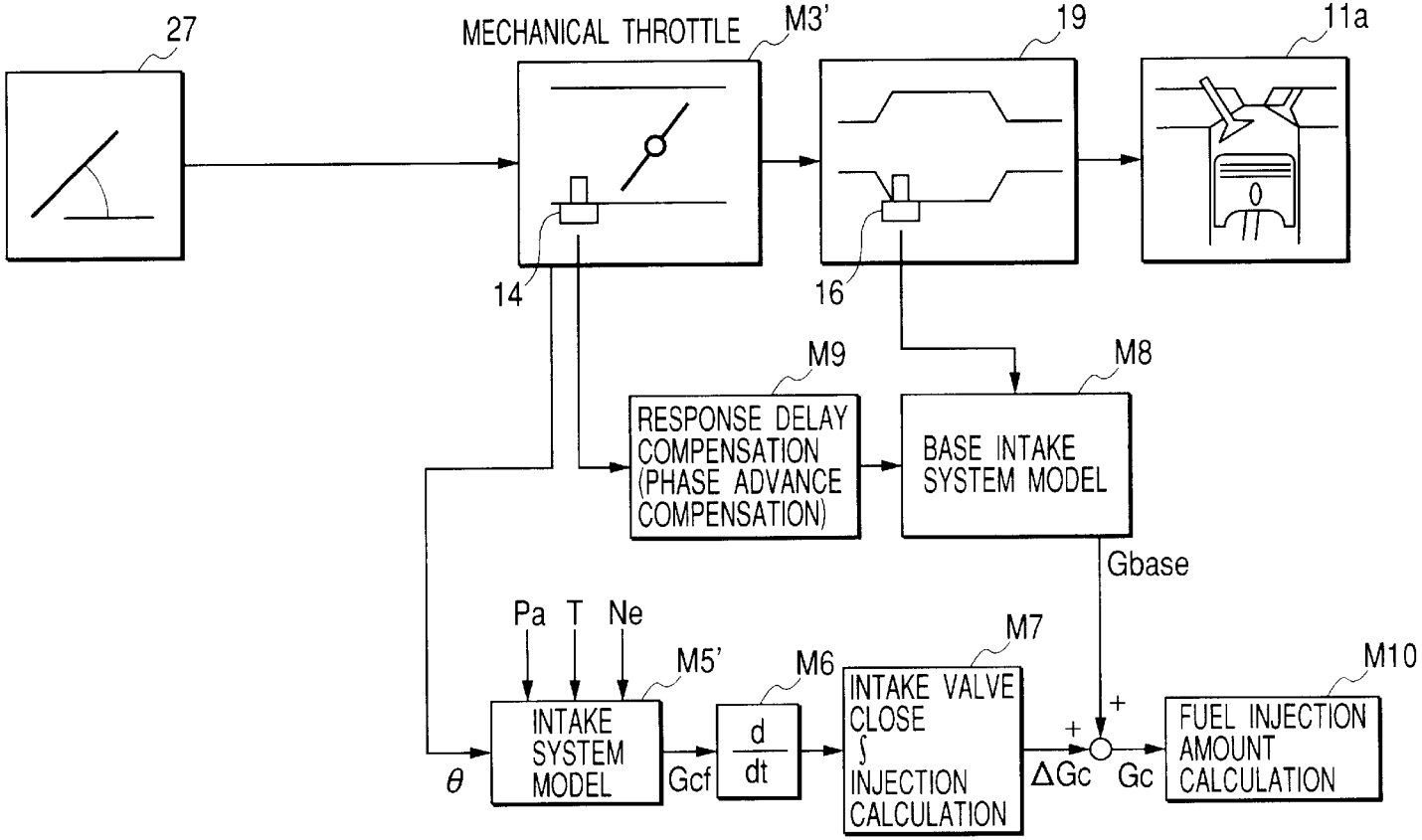
FIG. 21 is a block diagram showing the function of an electronic control unit in accordance with a third embodiment of the present invention.

FIG. 21 is a block diagram schematically showing a charged air amount predicting system in accordance with a third embodiment of the present invention. The system shown in FIG. 21 is applied to an engine equipped with a mechanical throttle system M3' mechanically linked with an accelerator for adjusting a throttle opening degree.

The third embodiment differs from the above-described first and second embodiments in that none of the opening degree command calculating means M1, the delay means M2, and the electronic throttle model M4 are provided because the mechanical linkage between the accelerator and the throttle valve causes response delay. Therefore, instead of inputting the predictive throttle opening degree to the intake system model (as being done in the first and second embodiments), the third embodiment inputs a present throttle opening degree (i.e., the output of the throttle opening sensor 18) into an intake system model M5'. The intake system model M5' of the third embodiment, whose arrangement is substantially the same as that of the first embodiment, calculates a provisional predictive charged air amount based on the present throttle opening degree. Then, the provisional predictive charged air amount is subjected to the derivative and integral processing to calculate a predictive change of the charged air amount at the intake valve close timing (or at the termination of a predetermined time duration). Then, the predictive change of the charged air amount is added with the base charged air amount calculated by the base intake system model M8, thereby finally obtaining a predictive charged air amount.

As apparent from the foregoing description, the third embodiment makes it possible to improve the calculation accuracy of the charged air amount even in a mechanical throttle system. Accordingly, it becomes possible to improve the air-fuel control accuracy during a transient state.

Fourth Embodiment

Figure 22:
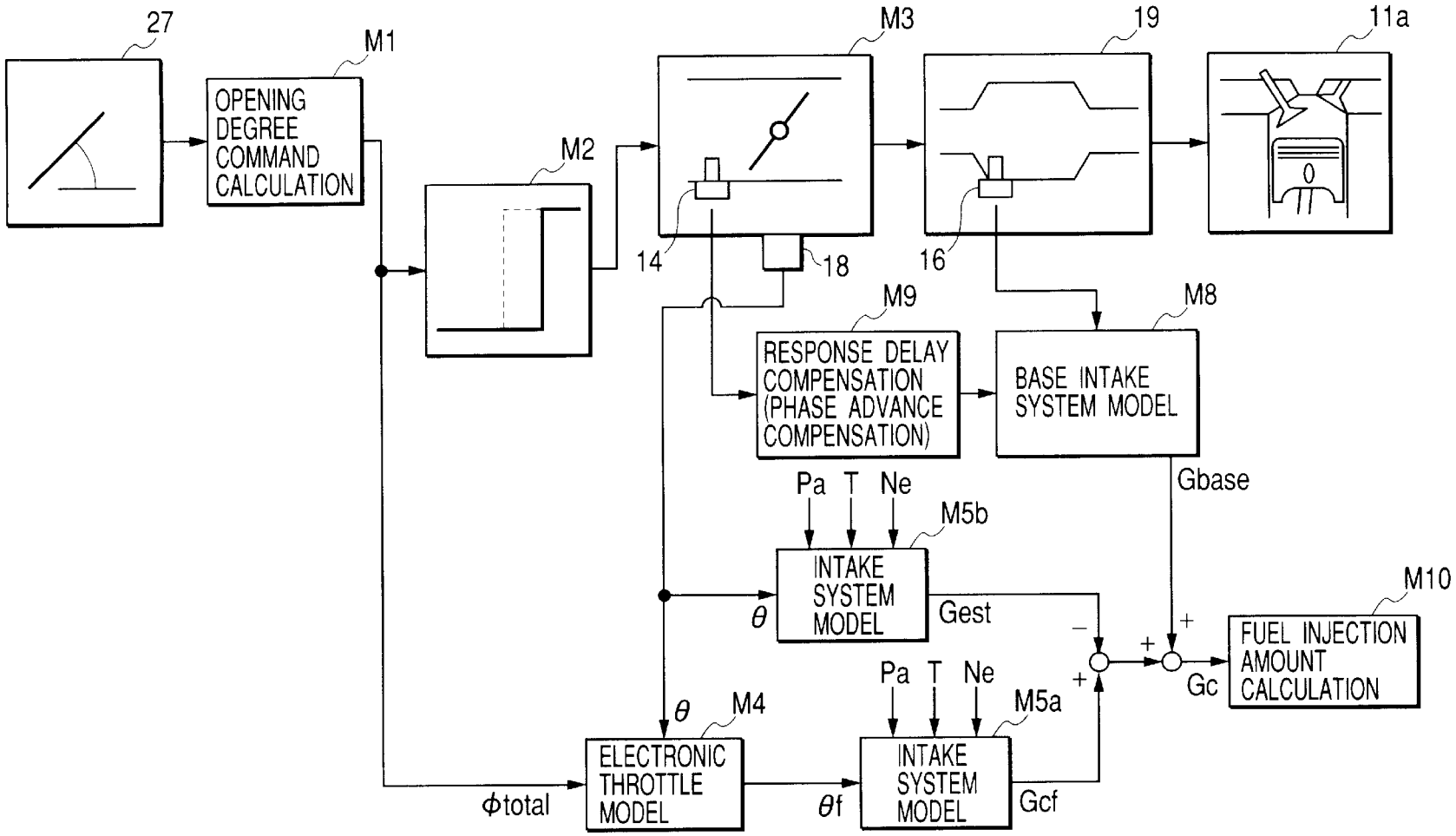
FIG. 22 is a block diagram showing the function of an electronic control unit in accordance with a fourth embodiment of the present invention.

FIG. 22 is a block diagram schematically showing a charged air amount predicting system in accordance with a fourth embodiment of the present invention.

According to the fourth embodiment, the electronic throttle model M4 calculates a predictive throttle opening degree at the intake valve close timing (or at the termination of dead time Tth) based on the opening degree command value and the present throttle opening (i.e., the output of throttle opening sensor 18). A first intake system model **M5*a* calculates a future charged air amount (i.e., a provisional predictive charged air amount) based on the predictive throttle opening degree. Meanwhile, a second intake system model M5*b* calculates a present charged air amount based on the present throttle opening degree (i.e., the output of throttle opening sensor 18). Then, a difference between the future charged air amount and the present charged air amount is obtained as a predictive change of the charged air amount. Then, the predictive change of the charged air amount is added with the base charged air amount calculated by the base intake system model M8, thereby finally obtaining a predictive charged air amount. Then, the fuel injection amount calculating means M10** calculates the fuel injection amount based on the predictive charged air amount.

Figure 23:
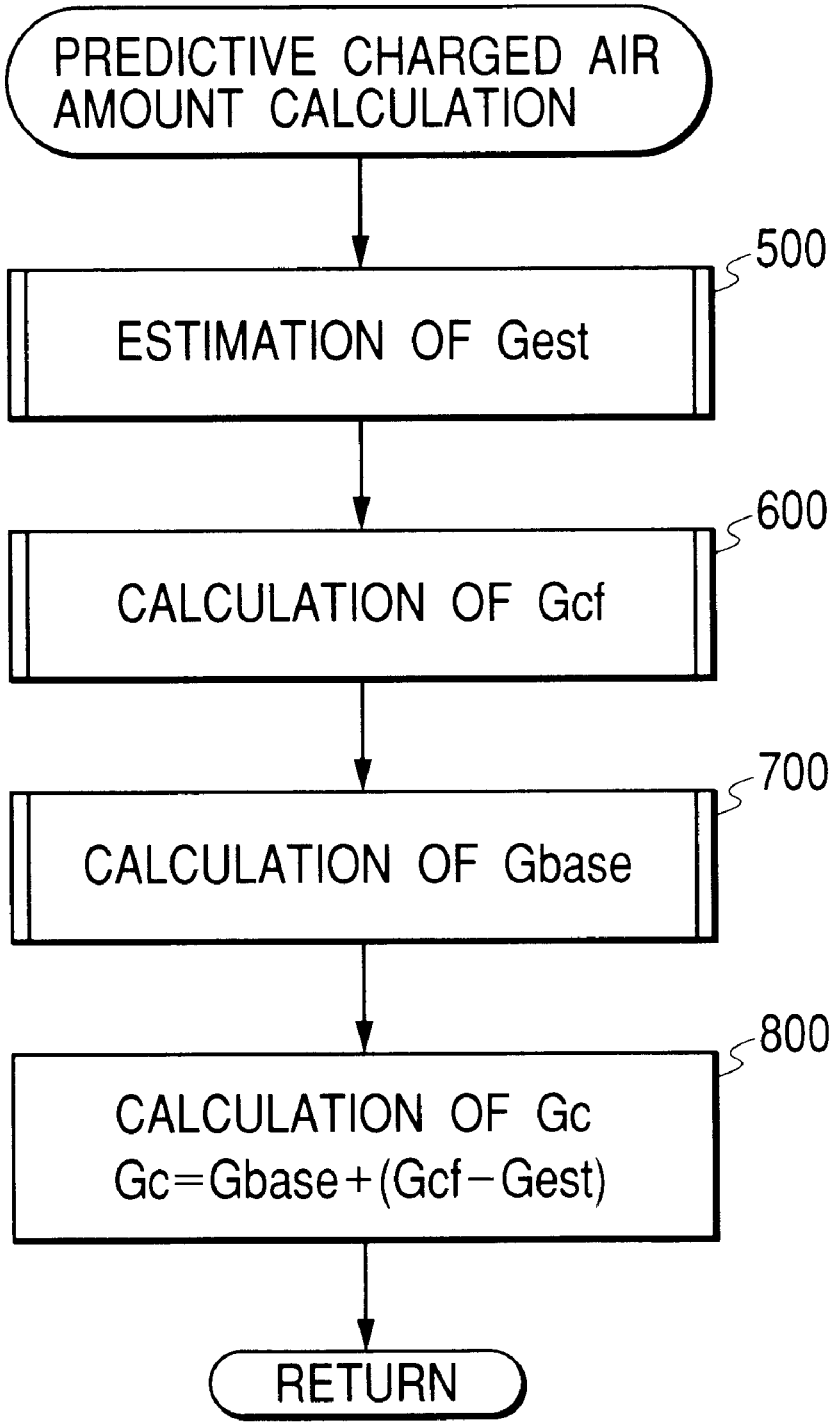
FIG. 23 is a flowchart showing a predictive charged air amount calculating routine performed in the electronic control unit in accordance with the fourth embodiment of the present invention.

According to the fourth embodiment, CPU 29 executes the main routine shown in FIG. 10, although the step 200 is performed according to a predictive charged air amount calculating routine shown in FIG. 23.

First in step 500, CPU 29 executes a present charged air amount estimating routine, which is later described with reference to the flowchart shown in FIG. 24, to calculate a present charged air amount Gest based on the present throttle opening degree θ (i.e., the output of throttle opening sensor 18).

Next, in step 600, CPU 29 executes a future charged air amount calculating routine, which is later described with reference to the flowchart shown in FIG. 25, to calculate a predictive throttle opening degree θf at the intake valve close timing (or the termination of dead time Tth) based on the opening degree command value and the present throttle opening degree θ according to the electronic throttle model M4 and then calculate a future charged air amount Gcf (i.e., a provisional predictive charged air amount) based on the predictive throttle opening degree θf according to the intake system model.

Then, in step 700, CPU 29 calculates the base charged air amount Gbase in the same manner as performed in the first embodiment.

Then, in step 800, CPU 29 adds a difference between the future charged air amount Gcf and the present charged air amount Gest to the base charged air amount Gbase, thereby finally obtaining a predictive charged air amount Gc.

$$Gc=Gbase+(Gcf-Gest)$$

Figure 24:
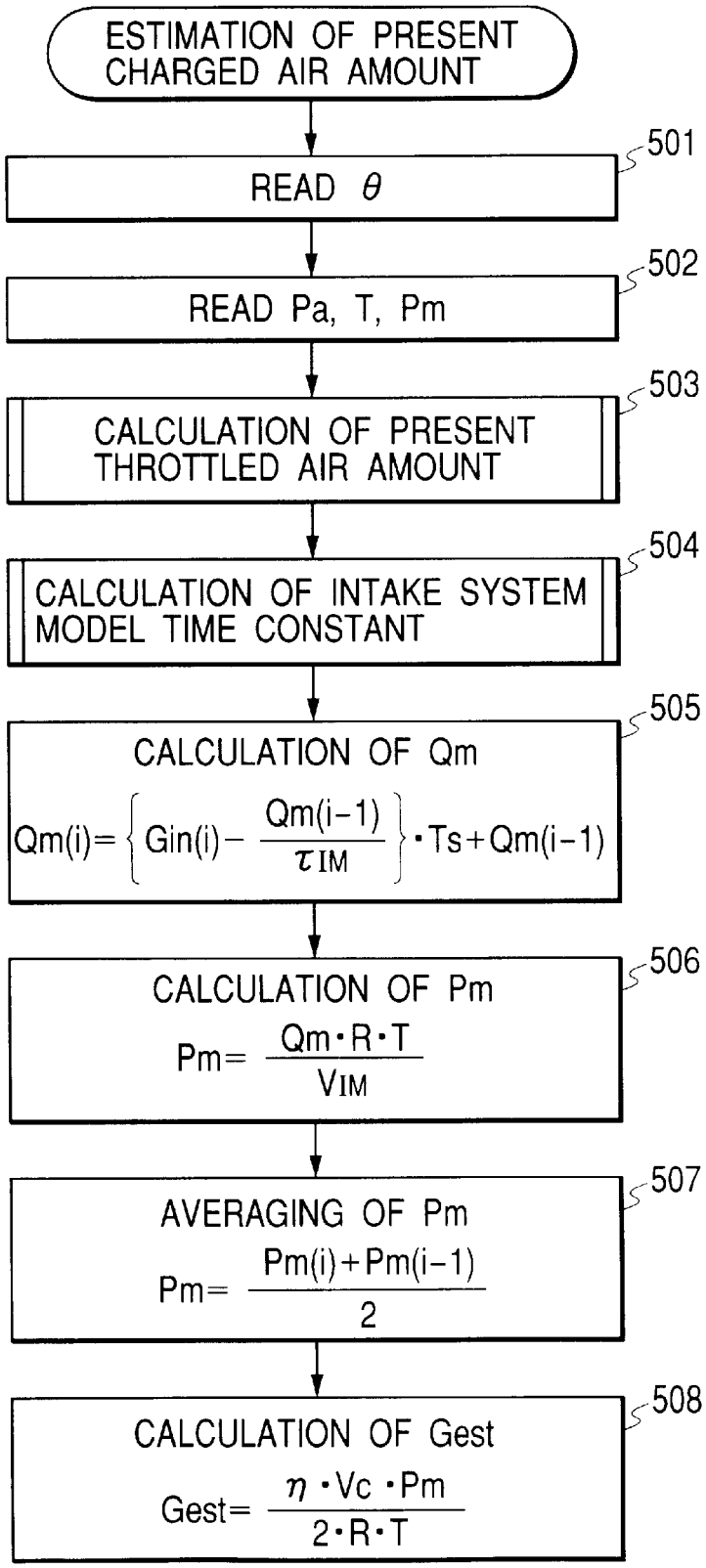
FIG. 24 is a flowchart showing a present charged air amount estimating routine performed in the electronic control unit in accordance with the fourth embodiment of the present invention.

FIG. 24 shows the details of the present charged air amount estimating routine executed in the step 500 shown in FIG. 23.

First in step 501, CPU 29 reads the present throttle opening degree θ.

Next, in step 502, CPU 29 reads the atmospheric pressure Pa, the intake temperature T, and the intake pressure Pm. In this case, the intake pressure Pm can be obtained from the intake pressure sensor 16 or from a previous predictive intake pressure later described in step 601 of FIG. 25.

Then, in step 503, CPU 29 calculates the present throttled air amount Gin in the same manner as performed in the routine shown in FIG. 14.

Then, in step 504, CPU 29 calculates the time constant $\tau_{IM}$ of the intake system model in the same manner as performed in the routine shown in FIG. 16.

Then, in step 505, CPU 29 calculates the air amount Qm in the throttle downstream intake passage according to the following expression in the same manner as performed in the step 213 of FIG. 13.

$$Qm(i)=\{Gin(i)-Qm(i-1)/\tau_{IM}\}Ts+Qm(i-1)$$

where Qm(i) represents a present air amount in the throttle downstream intake passage calculated at the present cycle, Qm(i−1) represents a previous air amount in the throttle downstream intake passage calculated at the previous cycle, and Ts represents a sampling time.

Then, in step 506, CPU 29 calculates a present intake pressure Pm based on the air amount Qm in the throttle downstream intake passage according to the following expression.

$$Pm=Qm\cdot R\cdot T/V_{IM}$$

where R represents the gas constant, T represents the intake temperature, and $V_{IM}$ represents a volume of the throttle downstream intake passage.

Then, in step 507, CPU 29 obtains an average of the present intake pressure according to the following expression.

$$Pm=\{Pm(i)+Pm(i-1)\}/2$$

where Pm(i) is a present intake pressure obtained at the present cycle, and Pm(i−1) is a previous intake pressure obtained at the previous cycle.

Then, in step 508, CPU 29 calculates a present charged air amount Gest based on the averaged intake pressure Pm.

$$Gest=\eta\cdot Vc\cdot Pm/(2\cdot R\cdot T)$$

η: volumetric efficiency

Vc: cylinder volume

R: gas constant

T: intake temperature

Figure 25:
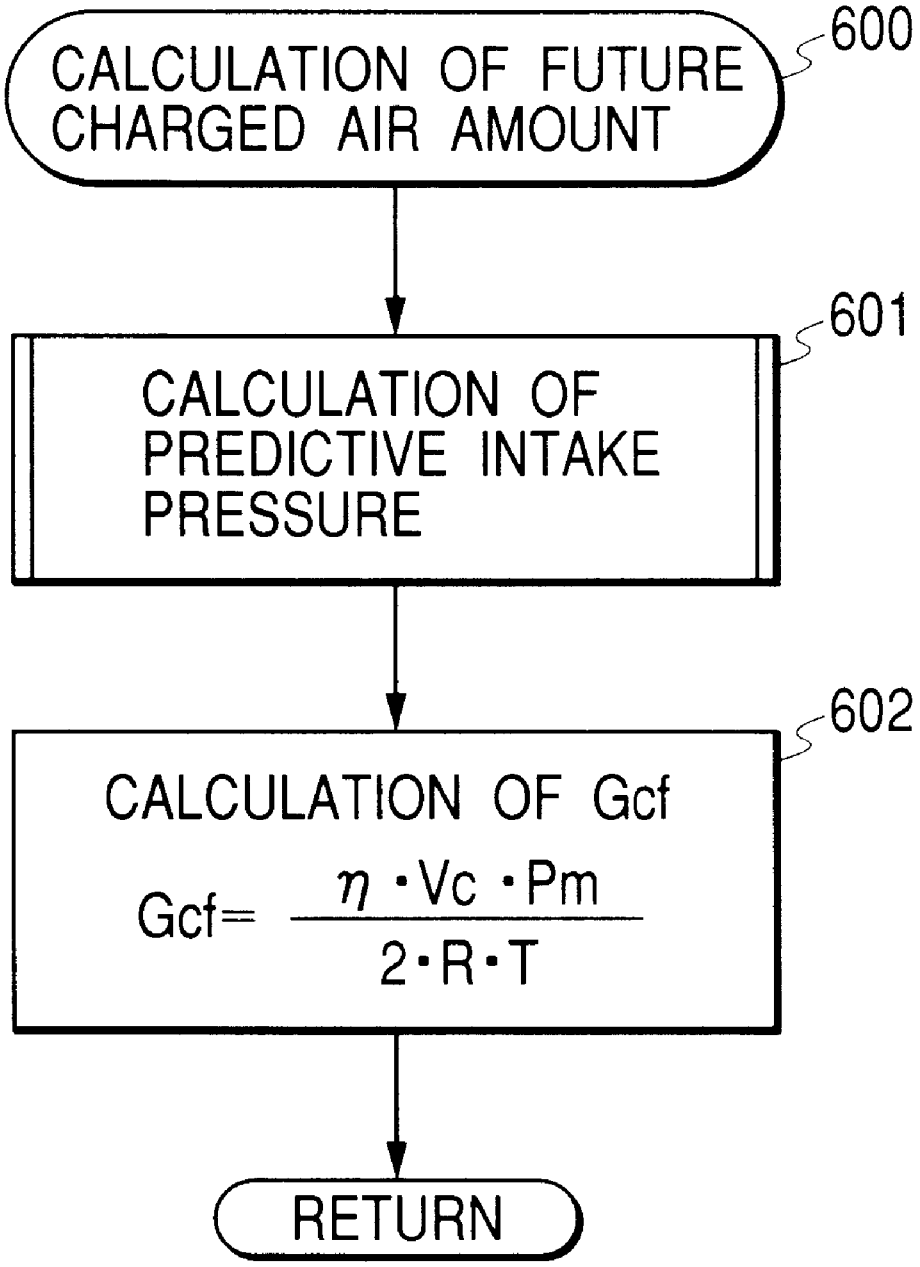
FIG. 25 is a flowchart showing a future charged air amount calculating routine performed in the electronic control unit in accordance with the fourth embodiment of the present invention.

FIG. 25 shows the details of the future charged air amount calculating routine executed in the step 600 shown in FIG. 23.

First in step 601, CPU 29 calculates the predictive intake pressure Pm (i.e., an intake pressure at the intake valve close timing) in the same manner as performed in the routine shown in FIG. 13.

Then, in step 602, CPU 29 calculates a future charged air amount Gcf (i.e., a charged air amount at the intake valve close timing) based on the predictive intake pressure Pm according to the following expression.

$$Gcf=\eta\cdot Vc\cdot Pm/(2\cdot R\cdot T)$$

According to the above-described fourth embodiment, the present charged air amount is estimated based on the present throttle opening degree. Meanwhile, the future charged air amount is calculated based on the predictive throttle opening degree. Then, a difference between the future charged air amount and the present charged air amount is obtained as a predictive change of the charged air amount. Thus, the forth embodiment can accurately predict a change of charged air and therefore can improve the predicting accuracy of the air charged into an engine cylinder.

Fifth Embodiment

Unlike the above-described first to fourth embodiments, the fifth embodiment employs an intake system model which calculates a charged air amount based on an output of the airflow meter 14. The time constant of this intake system model is set to a smaller value so that a change of the calculated charged air amount in this intake system model appears earlier than the actual change of charged air amount.

Setting such a smaller time constant according to this embodiment brings the same effects as that brought by predicting the future charged air amount based on the throttle opening degree. Thus, the fifth embodiment can improve the calculating accuracy of the charged air amount during a transient state, and therefore can improve the control accuracy of the air-fuel ratio during a transient state.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A control apparatus for an internal combustion engine equipped with a throttle valve mechanically linked with an accelerator pedal causing no response delay therebetween said control apparatus comprising:

base charged air amount calculating means for calculating a base charged air amount based on present operating parameters;

change amount predicting means for obtaining a predictive change of charged air amount charged into an engine cylinder during a predetermined predictive time terminating at an intake valve close timing based on an output of an intake system model according to which a throttle opening is regarded as an orifice and the law of mass conservation is applied to a throttled air amount and an intake air flowing in a throttle downstream intake passage;

charged air amount predicting means for obtaining a predictive charged air amount by adding said base charged air amount calculated by said base charged air amount calculating means to said predictive change obtained by said change amount predicting means; and fuel injection amount calculating means for calculating a fuel injection amount based on said predictive charged air amount obtained by said charged air amount predicting means.

2. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount and sending the calculated opening degree command value to said throttle actuator of said electronic throttle system without any delay;

throttle opening degree predicting means for obtaining a predictive throttle opening degree at an intake valve close timing based on the opening degree command value calculated by said opening degree command calculating means and response delay characteristics of said electronic throttle system;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means.

3. The control apparatus for an internal combustion engine in accordance with claim 2, wherein said charged air amount predicting means obtains a predictive change of charged air amount during a predetermined predictive time terminating at an intake valve close timing based on the predictive throttle opening degree obtained by said throttle opening degree predicting means, and adds the predictive change of charged air amount to a base charged air amount obtained based on present operating parameters to obtain said predictive charged air amount.

4. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means;

wherein said charged air amount predicting means obtains a predictive change of charged air amount during a predetermined predictive time terminating at an intake valve close timing based on the predictive throttle opening degree obtained by said throttle opening degree predicting means, and adds the predictive change of charged air amount to a base charged air amount obtained based on present operating parameters to obtain said predictive charged air amount, wherein said charged air amount predicting means uses an intake system model according to which a throttle opening is regarded as an orifice and the law of mass conservation is applied to a throttled air amount and an intake air flowing in a throttle downstream intake passage, and said predictive change of charged air amount is obtained by integrating an output of said intake system model during said predictive time terminating at an intake valve close timing.

5. The control apparatus for an internal combustion engine in accordance with claim 4, wherein said throttled air amount is obtained in said intake system model according to the following expression $$Gin = \mu \cdot A \cdot \frac{Pa}{\sqrt{R \cdot T}} \cdot f(Pm/Pa)$$

Gin: throttled air amount [kg/sec]

$\mu$: flow coefficient

A: effective cross-sectional area of throttle opening [$m^2$]

Pa: atmospheric pressure [Pa]

Pm: intake pressure [Pa]

R: gas constant

T: intake temperature [K]

f(Pm/Pa): physical value determined based on a ratio of Pm to Pa $A=\pi r^2(1-\cos^2\theta)$ r: radius of throttle valve [m]

θ: throttle opening degree wherein said charged air amount predicting means calculates f(Pm/Pa) from a table with a parameter of Pm/Pa, and calculates $\mu \cdot A$ from a table with a parameter of the predictive throttle opening degree.

6. The control apparatus for an internal combustion engine in accordance with claim 5, wherein the table used for calculating f(Pm/Pa) is set in the following manner f(Pm/Pa)=a positive value when Pm/Pa<1 f(Pm/Pa)=0 when Pm/Pa=1 and f(Pm/Pa)=a negative value when Pm/Pa>1 wherein said charged air amount predicting means includes a means for averaging a calculation value of said intake system model.

7. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means, wherein said delay means sets a delay time Tdly of said opening degree command value, wherein the delay time Tdly is expressed by $$Tdly=Tinj-Tth$$

when Tinj represents a predictive time from a fuel injection amount calculating timing to the intake valve close timing, and Tth represents a dead time of said electronic throttle system.

8. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means, wherein said delay means outputs said opening degree command value without any delay when said a predictive time Tinj from a fuel injection amount calculating timing to an intake valve close timing is shorter than a dead time Tth of said electronic throttle system.

9. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means, wherein said delay means outputs said opening degree command value without any delay when the engine is in any one of the following conditions:

1 a predetermined time has not elapsed since the engine operation is started;

2 the engine is in an idling condition; and 3 an automatic transmission is in a neutral condition.

10. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means, wherein said throttle opening degree predicting means obtains the predictive throttle opening degree responsive to a delayed outputting of said opening degree command value by using an electronic throttle model including a first-order or more higher order delay element inputting the non-delayed opening degree command value not delayed by said delay means and a speed limiter.

11. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means, wherein said throttle opening degree predicting means obtains a predictive throttle opening change during a predetermined predictive time terminating at an intake valve close timing by using an electronic throttle model, and obtains said predictive throttle opening degree at said intake valve close timing by adding said predictive throttle opening change to a present throttle opening degree.

12. A control apparatus for an internal combustion engine comprising:

an electronic throttle system for controlling a throttle opening degree, including a throttle actuator for driving a throttle valve;

opening degree command calculating means for calculating an opening degree command value based on an accelerator depression amount;

delay means for delaying an output timing of said opening degree command value calculated by said opening degree command calculating means sent to said throttle actuator;

throttle opening degree predicting means for obtaining a predictive throttle opening degree based on a non-delayed opening degree command value being not delayed by said delay means and response delay characteristics of said electronic throttle system, at a timing prior to outputting a delayed opening degree command value;

charged air amount predicting means for obtaining a predictive charged air amount charged into an engine cylinder based on the predictive throttle opening degree obtained by said throttle opening degree predicting means; and fuel injection amount calculating means for calculating a fuel injection amount based on said predictive charged air amount obtained by said charged air amount predicting means, wherein said fuel injection amount calculating means has a correcting means for correcting the fuel injection amount in accordance with engine operating conditions, and said correcting means uses a first correction factor for a load change caused by an accelerator depression which smaller than a second correction factor for a load change irrelevant to the accelerator depression.

13. A control apparatus for an internal combustion engine comprising:

present charged air amount estimating means for estimating a present charged air amount charged into an engine cylinder based on a present throttle opening degree;

throttle opening degree predicting means for estimating a future throttle opening degree based on the present throttle opening degree;

future charged air amount estimating means for predicting a future charged air amount based on said future throttle opening degree;

predictive charged air amount calculating means for obtaining a difference between said future charged air amount and the present charged air amount and adding said difference to a base charged air amount calculated based on present operating parameters to obtain a final predictive charged air amount; and fuel injection amount calculating means for calculating a fuel injection amount based on said final predictive charged air amount.

14. A control apparatus for an internal combustion engine equipped with a throttle valve mechanically linked with an accelerator pedal causing no response delay therebetween said control apparatus comprising:

intake airflow amount detecting means for detecting a flow amount of intake air flowing in an intake passage of an internal combustion engine; and calculating means, using an intake system model which simulates a behavior of intake air flowing in the intake passage after passing through a throttle valve and entering into the engine cylinder, for calculating a charged air amount charged into an engine cylinder by inputting an output of said intake airflow amount detecting means into said intake system model to obtained an output of said intake system model as said charged air amount;

wherein a time constant of said intake system model is set to a smaller value so that a change of calculated charged air amount in this intake system model appears earlier than an actual change of charged air amount.

* * * * *